US009728161B2

(12) United States Patent
Ikeda et al.

(10) Patent No.: US 9,728,161 B2
(45) Date of Patent: Aug. 8, 2017

(54) DISPLAY DEVICE

(71) Applicant: Japan Display Inc., Tokyo (JP)

(72) Inventors: Kojiro Ikeda, Tokyo (JP); Toshiyuki Nagatsuma, Tokyo (JP); Masaaki Kabe, Tokyo (JP); Amane Higashi, Tokyo (JP); Tae Kurokawa, Tokyo (JP); Fumitaka Gotoh, Tokyo (JP); Akira Sakaigawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 65 days.

(21) Appl. No.: 14/692,957

(22) Filed: Apr. 22, 2015

(65) Prior Publication Data

US 2015/0310830 A1 Oct. 29, 2015

(30) Foreign Application Priority Data

Apr. 25, 2014 (JP) ..... 2014-091913

(51) Int. Cl.

| | |
|---|---|
| ***G09G 5/02*** | (2006.01) |
| ***G09G 5/10*** | (2006.01) |
| ***G09G 3/36*** | (2006.01) |

(52) U.S. Cl.

CPC ..... *G09G 5/10* (2013.01); *G09G 3/3607* (2013.01); *G09G 3/3648* (2013.01); *G09G 5/02* (2013.01); *G09G 2300/0452* (2013.01); *G09G 2340/0457* (2013.01); *G09G 2340/06* (2013.01); *G09G 2360/16* (2013.01)

(58) Field of Classification Search

CPC ..... G09G 5/10; G09G 3/3648; G09G 3/3607; G09G 5/02; G09G 2300/0452; G09G 2340/06; G09G 2360/16; G09G 2340/0457

See application file for complete search history.

(56) References Cited

U.S. PATENT DOCUMENTS

2007/0070214 A1* 3/2007 Nakamura ..... G06K 9/00221 348/222.1
2007/0081722 A1* 4/2007 Friedrich ..... G06F 17/18 382/168

(Continued)

FOREIGN PATENT DOCUMENTS

JP 2011-100143 A 5/2011
JP 2012-108518 A 6/2012

*Primary Examiner* — Ibrahim Khan
(74) *Attorney, Agent, or Firm* — Michael Best & Friedrich LLP

(57) ABSTRACT

A display device includes a signal processing unit that receives input signals, and calculates output signals to a first sub-pixel, a second sub-pixel, a third sub-pixel, and a fourth sub-pixel. The signal processing unit calculates a frequency of pixels belonging to each of a plurality of partitions using a light quantity of a surface light source. The signal processing unit calculates an index value for each of the partitions by at least multiplying the cumulative frequency being obtained by sequentially adding the frequency of pixels from a partition having the maximum light quantity among the partitions, and the number of partitions representing a position of a partition to which the cumulative frequency belongs counted from the partition having the maximum light quantity. The signal processing unit controls luminance of the surface light source based on a partition in which the index value exceeds a threshold.

9 Claims, 16 Drawing Sheets

(56) References Cited

U.S. PATENT DOCUMENTS

| | | | | |
|---|---|---|---|---|
| 2007/0279372 | A1* | 12/2007 | Brown Elliott | G09G 3/3426 345/102 |
| 2008/0186322 | A1* | 8/2008 | Polak | G09G 5/02 345/589 |
| 2008/0297448 | A1 | 12/2008 | Mizukoshi et al. | |
| 2009/0102769 | A1* | 4/2009 | Kouno | G09G 3/3648 345/88 |
| 2009/0207182 | A1* | 8/2009 | Takada | G09G 3/3406 345/589 |
| 2009/0315921 | A1 | 12/2009 | Sakaigawa et al. | |
| 2009/0322802 | A1* | 12/2009 | Noguchi | G09G 3/2003 345/694 |
| 2010/0007679 | A1* | 1/2010 | Sakaigawa | G09G 3/3406 345/690 |
| 2011/0181635 | A1* | 7/2011 | Kabe | G09G 3/3426 345/694 |
| 2012/0013649 | A1* | 1/2012 | Higashi | G09G 3/3426 345/690 |
| 2015/0002552 | A1* | 1/2015 | Takagi | G09G 3/2003 345/690 |
| 2015/0097880 | A1* | 4/2015 | Ooga | G09G 3/3406 345/694 |

* cited by examiner

DISPLAY DEVICE

CROSS-REFERENCE TO RELATED APPLICATIONS

This application claims priority from Japanese Application No. 2014-091913, filed on Apr. 25, 2014, the contents of which are incorporated by reference herein in its entirety.

BACKGROUND

1. Technical Field

The present invention relates to a display device.

2. Description of the Related Art

In recent years, demand has been increased for display devices for a mobile apparatus and the like such as a cellular telephone and electronic paper. In such display devices, one pixel includes a plurality of sub-pixels that output different colors. Such display devices allow one pixel to display various colors by switching ON/OFF the display of the sub-pixels. Display characteristics such as resolution and luminance have been improved year after year in such display devices. However, an aperture ratio is reduced as the resolution increases, so that luminance of a backlight needs to increase to achieve high luminance, which leads to increase in power consumption of the backlight. To solve this problem, techniques have been developed for adding a white pixel serving as a fourth sub-pixel to red, green, and blue sub-pixels known in the art (for example, refer to Japanese Patent Application Laid-open Publication No. 2012-108518 and Japanese Patent Application Laid-open Publication No. 2011-100143). According to these techniques, the white pixel enhances the luminance to lower a current value of the backlight and reduce the power consumption.

The luminance of the backlight has an influence on a plurality of pixels of a display unit, and thus, if the luminance of the backlight is reduced in accordance with luminance of particular pixels displayed by input signals, the luminance at which other pixels should perform display may become insufficient, so that appropriate color components may not be allowed to be displayed.

For the foregoing reasons, there is a need for a display device that obtains an appropriate output signal of a fourth sub-pixel, different from a first sub-pixel, a second sub-pixel and a third sub-pixel, displaying a fourth color component, and that suppress deterioration in display quality of the display device.

SUMMARY

According to an aspect, a display device includes: a display unit that includes pixels arranged in a matrix therein, each of the pixels including a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel; a surface light source that irradiates the display unit; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel. The signal processing unit calculates a light quantity of the surface light source necessary for each of the pixels, and calculates a frequency of pixels belonging to each of a plurality of partitions using the obtained light quantity of the surface light source as a variable. The signal processing unit calculates an index value for each of the partitions by at least multiplying the cumulative frequency being obtained by sequentially adding the frequency of pixels from a partition having the maximum light quantity among the partitions, and the number of partitions representing a position of a partition to which the cumulative frequency belongs counted from the partition having the maximum light quantity. The signal processing unit controls luminance of the surface light source based on a partition in which the index value exceeds a threshold.

According to another aspect, a display device includes: a display unit that includes pixels arranged in a matrix therein, each of the pixels including a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel; a surface light source that irradiates the display unit; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel. The signal processing unit calculates a light quantity of the surface light source necessary for each of the pixels, and calculates a frequency of pixels belonging to each of a plurality of partitions using the obtained light quantity of the surface light source as a variable. The signal processing unit obtains a cumulative frequency by sequentially adding the frequency of pixels from a partition having the maximum light quantity among the partitions, and calculates an index value for each of the partitions, the index value being for each of the partitions, by adding the cumulative frequency of a target partition to a value obtained by multiplying an index value of a partition lying closer to the partition having the maximum light quantity than the target partition by a positive coefficient set for the target partition. The signal processing unit controls luminance of the surface light source based on a partition in which the index value exceeds a threshold.

DETAILED DESCRIPTION

Figure 1:
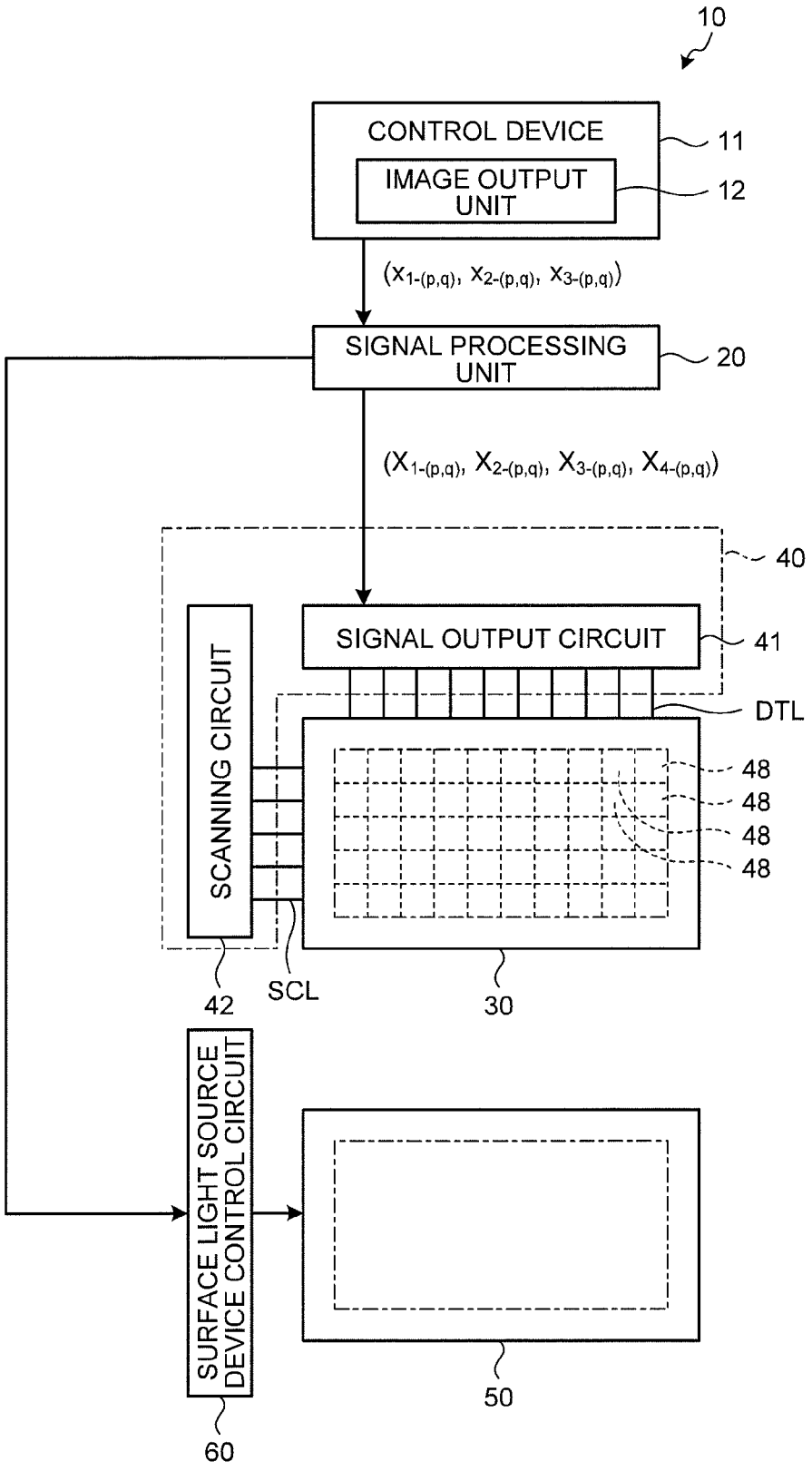
FIG. 1 is a block diagram illustrating an example of a configuration of a display device according to an embodiment.

The following describes a preferred embodiment in detail with reference to the drawings. The present invention is not limited to the embodiment described below. Components described below include a component that is easily conceivable by those skilled in the art and substantially the same component. The components described below can be appropriately combined. The disclosure is merely an example, and the present invention naturally encompasses an appropriate modification maintaining the gist of the invention that is easily conceivable by those skilled in the art. To further clarifying the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

Figure 2:
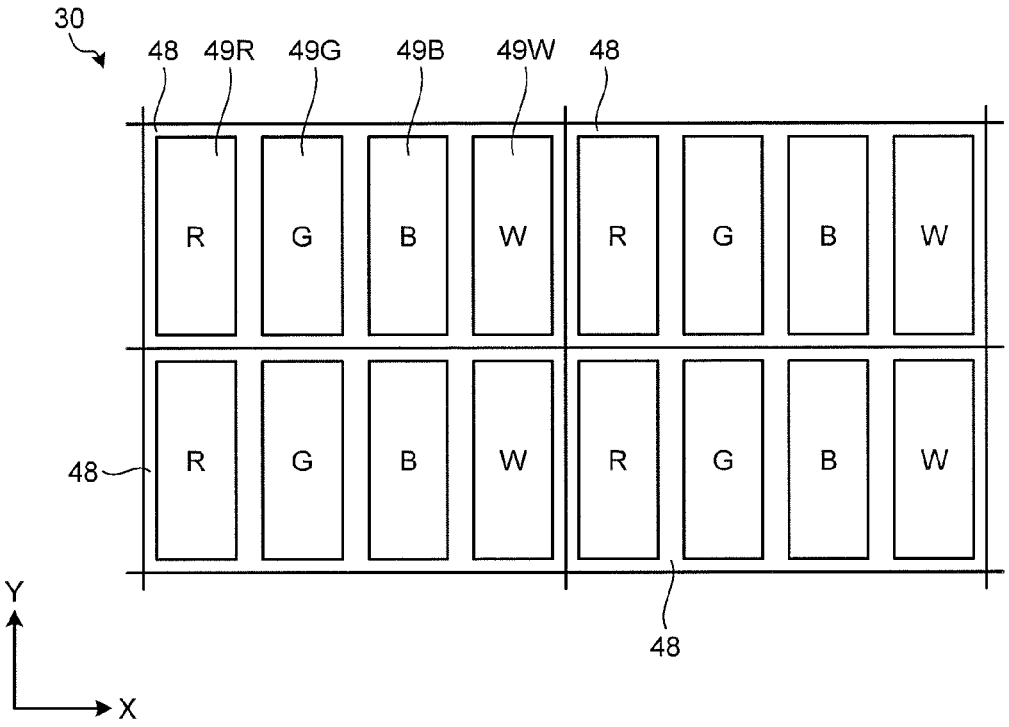
FIG. 2 is a diagram illustrating a pixel array of an image display panel according to the embodiment.
Figure 3:
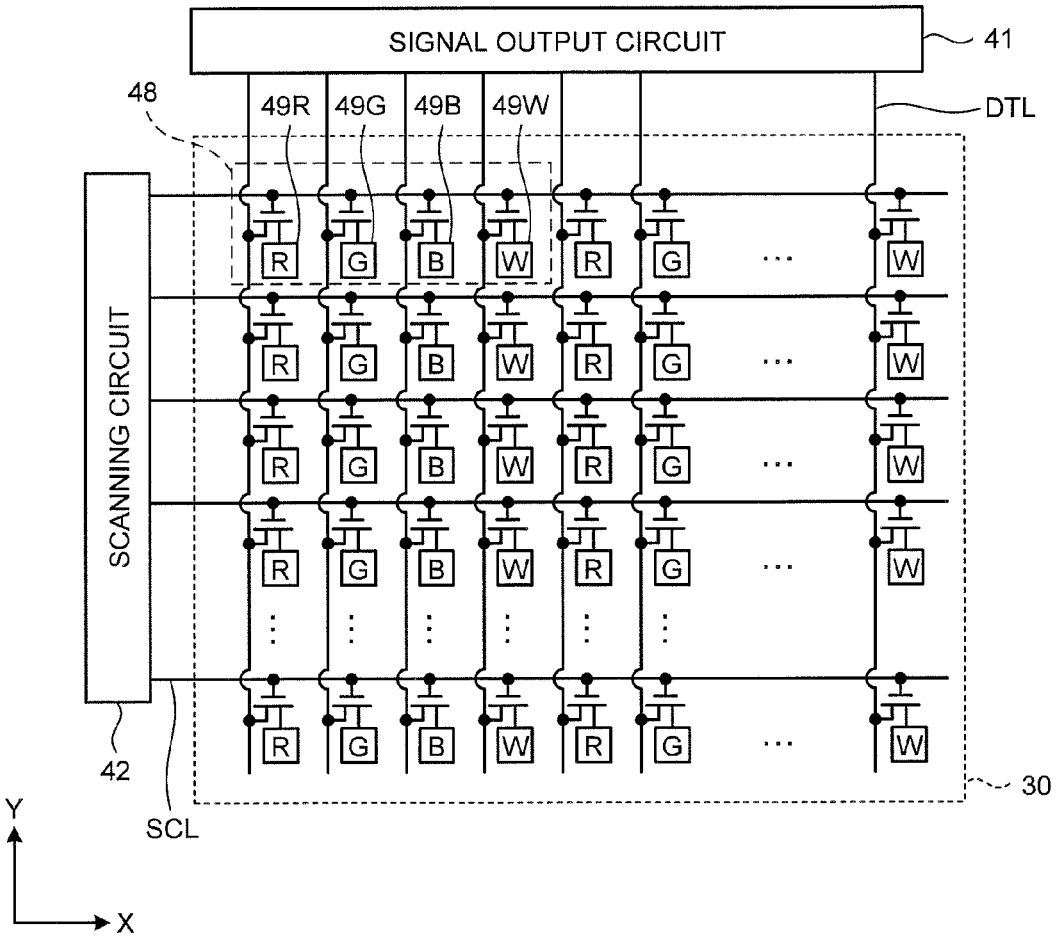
FIG. 3 is a conceptual diagram of the image display panel and an image display panel drive circuit of the display device according to the embodiment.
Figure 4:
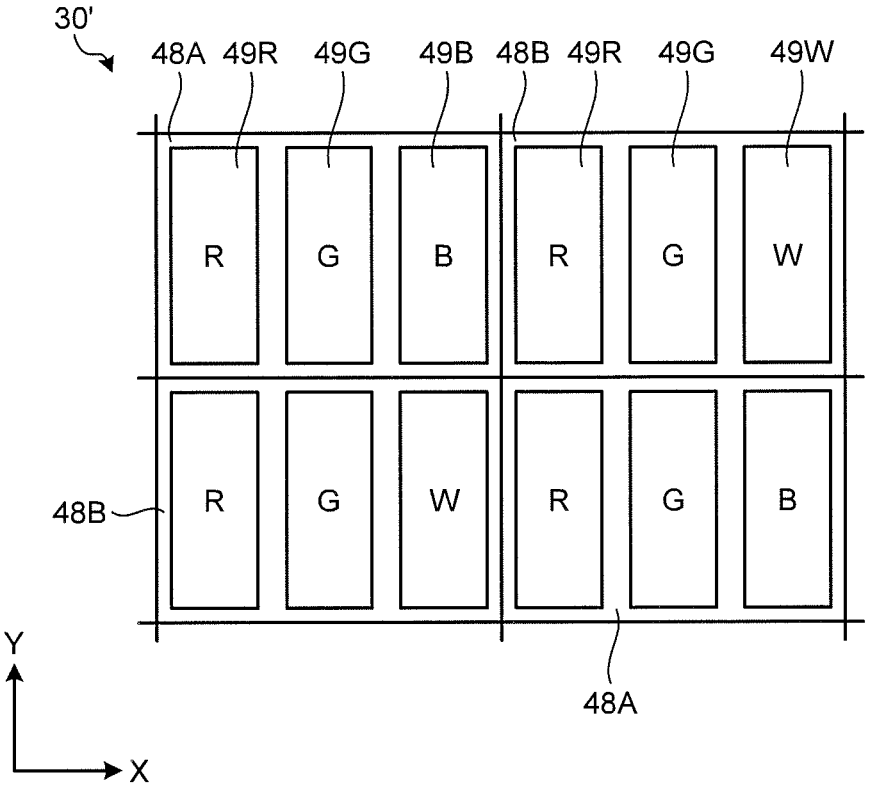
FIG. 4 is a diagram illustrating another example of the pixel array of the image display panel according to the embodiment.

FIG. 1 is a block diagram illustrating an example of a configuration of a display device according to an embodiment. FIG. 2 is a diagram illustrating a pixel array of an image display panel according to the embodiment. FIG. 3 is a conceptual diagram of the image display panel and an image display panel drive circuit of the display device according to the embodiment. FIG. 4 is a diagram illustrating another example of the pixel array of the image display panel according to the embodiment.

As illustrated in FIG. 1, a display device 10 includes a signal processing unit 20 that receives an input signal (RGB data) from an image output unit 12 of a control device 11 and executes predetermined data conversion processing on the signal to be output, an image display panel (display unit) 30 that displays an image based on an output signal output from the signal processing unit 20, an image display panel drive circuit 40 that controls driving of an image display panel 30, a surface light source device 50 that illuminates the image display panel 30 from its back surface, and a surface light source device control circuit 60 that controls driving of the surface light source device 50. The display device 10 has the same configuration as that of an image display device assembly disclosed in Japanese Patent Application Laid-open Publication No. 2011-154323 (JP-A-2011-154323), and various modifications described in JP-A-2011-154323 can be applied thereto.

The signal processing unit 20 is a calculation processing unit that controls operations of the image display panel 30 and the surface light source device 50. The signal processing unit 20 is coupled to the image display panel drive circuit 40 for driving the image display panel 30, and the surface light source device control circuit 60 for driving the surface light source device 50. The signal processing unit 20 processes the input signal input from the outside to generate the output signal and a surface light source device control signal. That is, the signal processing unit 20 converts an input value (input signal) of an input signal in an input HSV color space into an extended value (output signal) in an extended HSV color space extended with the first color, the second color, the third color, and the fourth color components to be generated, and outputs the generated output signal to the image display panel 30. The signal processing unit 20 then outputs the generated output signal to the image display panel drive circuit 40 and outputs the generated surface light source device control signal to the surface light source device control circuit 60.

As illustrated in FIGS. 2 and 3, the pixels 48 are arranged in a two-dimensional matrix of $P_0 \times Q_0$ ($P_0$ in a row direction, and $Q_0$ in a column direction) in the image display panel 30. FIGS. 2 and 3 illustrate an example in which the pixels 48 are arranged in a matrix on an XY two-dimensional coordinate system. In this example, the row direction is the X-direction and the column direction is the Y-direction.

Each of the pixels 48 includes a first sub-pixel 49R, a second sub-pixel 49G, a third sub-pixel 49B, and a fourth sub-pixel 49W. The first sub-pixel 49R displays a first color component (for example, red as a first primary color). The second sub-pixel 49G displays a second color component (for example, green as a second primary color). The third sub-pixel 49B displays a third color component (for example, blue as a third primary color). The fourth sub-pixel 49W displays a fourth color component (for example, white). In the following description, the first sub-pixel 49R, the second sub-pixel 49G, the third sub-pixel 49B, and the fourth sub-pixel 49W may be collectively referred to as a sub-pixel 49 when they are not required to be distinguished from each other. The image output unit 12 described above outputs RGB data that can be displayed with the first color component, the second color component, and the third color component in the pixel 48 as the input signal to the signal processing unit 20.

More specifically, the display device 10 is a transmissive color liquid crystal display device. The image display panel 30 is a color liquid crystal display panel in which a first color filter that allows the first primary color to pass through is arranged between the first sub-pixel 49R and an image observer, a second color filter that allows the second primary color to pass through is arranged between the second sub-pixel 49G and the image observer, and a third color filter that allows the third primary color to pass through is arranged between the third sub-pixel 49B and the image observer. In the image display panel 30, there is no color filter between the fourth sub-pixel 49W and the image observer. A transparent resin layer may be provided for the fourth sub-pixel 49W instead of the color filter. In this way, by arranging the transparent resin layer, the image display panel 30 can suppress occurrence of a large level difference in the fourth sub-pixel 49W, otherwise the large level difference occurs because of arranging no color filter for the fourth sub-pixel 49W.

In the example illustrated in FIG. 2, the first sub-pixel 49R, the second sub-pixel 49G, the third sub-pixel 49B, and the fourth sub-pixel 49W are arranged similarly to a stripe array in the image display panel 30. A structure and an arrangement of the sub-pixels 49R, 49G, 49B, and 49W included in one pixel 48 are not specifically limited. For example, the first sub-pixel 49R, the second sub-pixel 49G, the third sub-pixel 49B, and the fourth sub-pixel 49W may be arranged similarly to a diagonal array (mosaic array) in the image display panel 30. The arrangement may be similar to a delta array (triangle array) or a rectangle array, for example. As in an image display panel 30' illustrated in FIG. 4, a pixel 48A including the first sub-pixel 49R, the second sub-pixel 49G, and the third sub-pixel 49B and a pixel 48B including the first sub-pixel 49R, the second sub-pixel 49G, and the fourth sub-pixel 49W are alternately arranged in the row direction and the column direction.

Generally, the arrangement similar to the stripe array is preferable for displaying data or character strings on a personal computer and the like. In contrast, the arrangement similar to the mosaic array is preferable for displaying a natural image on a video camera recorder, a digital still camera, or the like.

The image display panel drive circuit 40 includes a signal output circuit 41 and a scanning circuit 42. In the image display panel drive circuit 40, the signal output circuit 41 holds video signals to be sequentially output to the image display panel 30. The signal output circuit 41 is electrically coupled to the image display panel 30 via wiring DTL. In the image display panel drive circuit 40, the scanning circuit 42 controls ON/OFF of a switching element (for example, a thin film transistor (TFT)) for controlling an operation of the sub-pixel (light transmittance) in the image display panel 30. The scanning circuit 42 is electrically coupled to the image display panel 30 via wiring SCL.

The surface light source device 50 is arranged on a back surface of the image display panel 30, and illuminates the image display panel 30 by irradiating the image display panel 30 with light. The surface light source device 50 irradiates the entire surface of the image display panel 30 with light to illuminate the image display panel 30. The surface light source device control circuit 60 controls irradiation light quantity and the like of the light output from the surface light source device 50. Specifically, the surface light source device control circuit 60 adjusts, for example, an electric current to be supplied to the surface light source device 50 using, for example, pulse width modulation (PWM) based on the surface light source device control signal output from the signal processing unit 20 to adjust output power of the surface light source device 50 (corresponding to light source power to be described below). This adjustment controls the light quantity (light intensity) of the light with which the image display panel 30 is irradiated.

Figure 5:
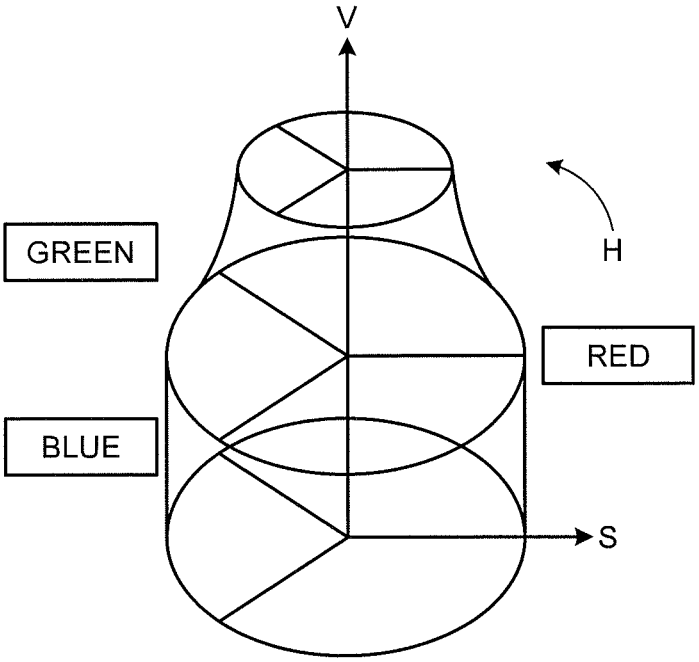
FIG. 5 is a conceptual diagram of an extended HSV color space that can be extended by the display device according to the embodiment.
Figure 6:
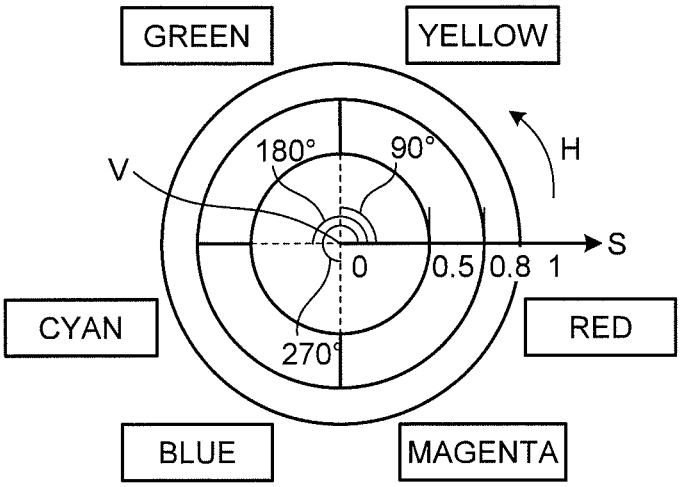
FIG. 6 is a conceptual diagram illustrating a relation between a hue and saturation in the extended HSV color space.

FIG. 5 is a conceptual diagram of the extended HSV color space that can be extended by the display device according to the embodiment. FIG. 6 is a conceptual diagram illustrating a relation between a hue and saturation in the extended HSV color space. The signal processing unit 20 receives an input signal that is information of an image to be displayed input from the outside. The input signal includes the information of the image (color) to be displayed at its position for each pixel 48 as the input signal. Specifically, in the image display panel 30 in which $P_0 \times Q_0$ pixels 48 are arranged in a matrix, with respect to the (p, q)-th pixel 48 (where $1 \leq p \leq P_0$, $1 \leq q \leq Q_0$), the signal processing unit 20 receives a signal including an input signal of the first sub-pixel 49R the signal value of which is $x_{1-(p,\ p)}$, an input signal of the second sub-pixel 49G the signal value of which is $x_{2-(p,\ q)}$, and an input signal of the third sub-pixel 49B the signal value of which is $x_{3-(p,\ q)}$ (refer to FIG. 1).

The signal processing unit 20 illustrated in FIG. 1 processes the input signal to generate an output signal of the first sub-pixel for determining display gradation of the first sub-pixel 49R (signal value $X_{1-(p,\ q)}$), an output signal of the second sub-pixel for determining the display gradation of the second sub-pixel 49G (signal value $X_{2-(p,\ q)}$), an output signal of the third sub-pixel for determining the display gradation of the third sub-pixel 49B (signal value $X_{3-(p,\ q)}$), and an output signal of the fourth sub-pixel for determining the display gradation of the fourth sub-pixel 49W (signal value $X_{4-(p,\ q)}$) to be output to the image display panel drive circuit 40.

In the display device 10, the pixel 48 includes the fourth sub-pixel 49W for outputting the fourth color component (for example, white) to widen a dynamic range of the brightness in the HSV color space (extended HSV color space) as illustrated in FIG. 5. That is, as illustrated in FIG. 5, a substantially trapezoidal three-dimensional shape, in which the maximum value of the brightness V is reduced as the saturation S increases, is placed on a cylindrical HSV color space that can be displayed by the first sub-pixel 49R, the second sub-pixel 49G, and the third sub-pixel 49B.

The signal processing unit 20 stores the maximum value Vmax(S) of the brightness using the saturation S as a variable in the HSV color space expanded by adding the fourth color component (white). That is, the signal processing unit 20 stores the maximum value Vmax(S) of the brightness for respective coordinates (value) of the saturation and the hue regarding the three-dimensional shape of the HSV color space illustrated in FIG. 5. The input signals include the input signals of the first sub-pixel 49R, the second sub-pixel 49G, and the third sub-pixel 49B, so that the HSV color space of the input signals has a cylindrical shape, that is, the same shape as a cylindrical part of the extended HSV color space.

Next, the signal processing unit 20 calculates the output signal (signal value $X_{1-(p,q)}$) of the first sub-pixel 49R based on at least the input signal (signal value $x_{1-(p,q)}$) of the first sub-pixel 49R and an expansion coefficient α, and outputs the result to the first sub-pixel 49R. The signal processing unit 20 also calculates the output signal (signal value $X_{2-(p,q)}$) of the second sub-pixel 49G based on at least the input signal (signal value $x_{2-(p,q)}$) of the second sub-pixel 49G and the expansion coefficient α, and outputs the result to the second sub-pixel 49G. The signal processing unit 20 also calculates the output signal (signal value $X_{3-(p,q)}$) of the third sub-pixel 49B based on at least the input signal (signal value $x_{3-(p,q)}$) of the third sub-pixel 49B and the expansion coefficient α, and outputs the result to the third sub-pixel 49B. The signal processing unit 20 further calculates the output signal (signal value $X_{4-(p,q)}$) of the fourth sub-pixel 49W based on the input signal (signal value $x_{1-(p,q)}$) of the first sub-pixel 49R, the input signal (signal value $x_{2-(p,q)}$) of the second sub-pixel 49G, and the input signal (signal value $x_{3-(p,q)}$) of the third sub-pixel 49B, and outputs the result to the fourth sub-pixel 49W.

Specifically, the signal processing unit 20 calculates the output signal of the first sub-pixel 49R based on the expansion coefficient α of the first sub-pixel 49R and the output signal of the fourth sub-pixel 49W, calculates the output signal of the second sub-pixel 49G based on the expansion coefficient α of the second sub-pixel 49G and the output signal of the fourth sub-pixel 49W, and calculates the output signal of the third sub-pixel 49B based on the expansion coefficient α of the third sub-pixel 49B and the output signal of the fourth sub-pixel 49W.

That is, assuming that χ is a constant depending on the display device 10, the signal processing unit 20 obtains, from the following expressions (1) to (3), the signal value $X_{1-(p,q)}$ as the output signal of the first sub-pixel 49R, the signal value $X_{2-(p,q)}$ as the output signal of the second sub-pixel 49G, and the signal value $X_{3-(p,q)}$ as the output signal of the third sub-pixel 49B, each of those signal values being output to the (p, q)-th pixel (or a group of the first sub-pixel 49R, the second sub-pixel 49G, and the third sub-pixel 49B).

$$X_{1-(p,q)}=\alpha\cdot x_{1-(p,q)}-\chi\cdot X_{4-(p,q)} \quad (1)$$

$$X_{2-(p,q)}=\alpha\cdot x_{2-(p,q)}-\chi\cdot X_{4-(p,q)} \quad (2)$$

$$X_{3-(p,q)}=\alpha\cdot x_{3-(p,q)}-\chi\cdot X_{4-(p,q)} \quad (3)$$

The signal processing unit 20 obtains the maximum value Vmax(S) of the brightness using the saturation S as a variable in the HSV color space expanded by adding the fourth color element, and obtains the saturation S and the brightness V(S) in the pixels 48 based on the input signal values of the sub-pixels 49 in the pixels 48.

The saturation S and the brightness V(S) are expressed as follows: S=(Max− Min)/Max, and V(S)=Max. The saturation S may take values of 0 to 1, the brightness V(S) may take values of 0 to $(2^n-1)$, and n is a display gradation bit number. Max is the maximum value among the input signal value of the first sub-pixel 49R, the input signal value of the second sub-pixel 49G, and the input signal value of the third sub-pixel 49B, each of those signal values being input to the pixel 48. Min is the minimum value among the input signal value of the first sub-pixel 49R, the input signal value of the second sub-pixel 49G, and the input signal value of the third sub-pixel 49B, each of those signal values being input to the pixel 48. A hue H is represented in a range of 0° to 360° as illustrated in FIG. 6. Arranged are red, yellow, green, cyan, blue, magenta, and red from 0° to 360°.

According to the embodiment, the signal value $X_{4-(p,q)}$ can be obtained based on a product of $Min_{(p,q)}$ and the expansion coefficient α. Specifically, the signal value $X_{4-(p,q)}$ can be obtained based on the following expression (4). In the expression (4), the product of $Min_{(p,q)}$ and the expansion coefficient α is divided by χ. However, the embodiment is not limited thereto. χ will be described later. The expansion coefficient α is determined for each image display frame.

$$X_{4-(p,q)}=Min_{(p,q)}\cdot\alpha/\chi \quad (4)$$

Generally, in the (p, q)-th pixel, the saturation $S_{(p,q)}$ and the brightness $V(S)_{(p,q)}$ in the cylindrical HSV color space can be obtained from the following expressions (5) and (6) based on the input signal (signal value $x_{1-(p,q)}$) of the first sub-pixel 49R, the input signal (signal value $x_{2-(p,q)}$) of the second sub-pixel 49G, and the input signal (signal value $x_{3-(p,q)}$) of the third sub-pixel 49B.

$$S_{(p,q)}=(Max_{(p,q)}-Min_{(p,q)})/Max_{(p,q)} \quad (5)$$

$$V(S)_{(p,q)}=Max_{(p,q)} \quad (6)$$

In the above expressions, $Max_{(p,q)}$ represents the maximum value among the input signal values of three sub-pixels 49 ($x_{1-(p,q)}$, $x_{2-(p,q)}$, and $x_{3-(p,q)}$), and $Min_{(p,q)}$ represents the minimum value among the input signal values of three sub-pixels 49 ($x_{1-(p,q)}$, $x_{2-(p,q)}$, and $x_{3-(p,q)}$). In the embodiment, n is assumed to be 8. That is, the display gradation bit number is assumed to be 8 bits (a value of the display gradation is assumed to be 256 gradations, that is, 0 to 255).

No color filter is arranged for the fourth sub-pixel 49W that displays white. When a signal having a value corresponding to the maximum signal value of the output signal of the first sub-pixel is input to the first sub-pixel 49R, a signal having a value corresponding to the maximum signal value of the output signal of the second sub-pixel is input to the second sub-pixel 49G, and a signal having a value corresponding to the maximum signal value of the output signal of the third sub-pixel is input to the third sub-pixel 49B, luminance of an aggregate of the first sub-pixel 49R, the second sub-pixel 49G, and the third sub-pixel 49B included in the pixel 48 or a group of pixels 48 is assumed to be $BN_{1-3}$. When a signal having a value corresponding to the maximum signal value of the output signal of the fourth sub-pixel 49W is input to the fourth sub-pixel 49W included in the pixel 48 or a group of pixels 48, the luminance of the fourth sub-pixel 49W is assumed to be $BN_4$. That is, white (maximum luminance) is displayed by the aggregate of the first sub-pixel 49R, the second sub-pixel 49G, and the third sub-pixel 49B, and the luminance of the white is represented by $BN_{1-3}$. Assuming that χ is a constant depending on the display device, the constant χ is represented by $\chi=BN_4/BN_{1-3}$.

Specifically, the luminance $BN_4$ when the input signal having a value of display gradation 255 is assumed to be input to the fourth sub-pixel 49W is 1.5 times the luminance $BN_{1-3}$ of white when it is assumed that the input signals having values of display gradation such as the signal value $x_{1-(p,q)}=255$, the signal value $x_{2-(p,q)}=255$, and the signal value $x_{3-(p,q)}=255$, are input to the aggregate of the first sub-pixel 49R, the second sub-pixel 49G, and the third sub-pixel 49B. That is, χ is 1.5 in the embodiment.

If the signal value $X_{4-(p,\ q)}$ is given by the expression (4) above, Vmax(S) can be represented by the following expressions (7) and (8).

When $S \leq S_0$, $$V\max(S)=(\chi+1)\cdot(2^n-1) \tag{7}$$

When $S_0 < S \leq 1$, $$V\max(S)=(2^n-1)\cdot(1/S) \tag{8}$$

In this case, $S_0=1/(\chi+1)$ is satisfied.

The thus obtained maximum value Vmax(S) of the brightness using the saturation S as a variable in the HSV color space expanded by adding the fourth color component is stored in the signal processing unit 20 as a kind of look-up table, for example. Alternatively, the signal processing unit 20 obtains the maximum value Vmax(S) of the brightness using the saturation S as a variable in the expanded HSV color space as occasion demands.

Next, the following describes a method of obtaining the signal values $X_{1-(p,\ q)}$, $X_{2-(p,\ q)}$, $X_{3-(p,\ q)}$, and $X_{4-(p,\ q)}$ as output signals of the (p, q)-th pixel 48 (expansion processing). The following processing is performed to keep a ratio among the luminance of the first primary color displayed by (first sub-pixel 49R+ fourth sub-pixel 49W), the luminance of the second primary color displayed by (second sub-pixel 49G+ fourth sub-pixel 49W), and the luminance of the third primary color displayed by (third sub-pixel 49B+ fourth sub-pixel 49W). The processing is performed to also keep (maintain) color tone. In addition, the processing is performed to keep (maintain) a gradation-luminance characteristic (gamma characteristic, γ characteristic). When all of the input signal values are 0 or smaller values in any one of the pixels 48 or a group of the pixels 48, the expansion coefficient α may be obtained without including such pixel 48 or a group of pixels 48.

First Process

First, the signal processing unit 20 obtains the saturation S and the brightness V(S) in the pixels 48 based on the input signal values of the sub-pixels 49 of the pixels 48. Specifically, $S_{(p,\ q)}$ and $V(S)_{(p,\ q)}$ are obtained from the expressions (5) and (6) based on the signal value $x_{1-(p,\ q)}$ that is the input signal of the first sub-pixel 49R, the signal value $x_{2-(p,\ q)}$ that is the input signal of the second sub-pixel 49G, and the signal value $x_{3-(p,\ q)}$ that is the input signal of the third sub-pixel 49B, each of those signal values being input to the (p, q)-th pixel 48. The signal processing unit 20 performs this processing on all of the pixels 48.

Second Process

Next, the signal processing unit 20 obtains the expansion coefficient α(S) based on the Vmax(S)/V(S) obtained in the pixels 48.

$$\alpha(S)=V\max(S)/V(S) \tag{9}$$

Third Process

Next, the signal processing unit 20 obtains the signal value $X_{4-(p,\ q)}$ in the (p, q)-th pixel 48 based on at least the signal value $X_{1-(p,\ q)}$, the signal value $x_{2-(p,\ q)}$, and the signal value $X_{3-(p,\ q)}$ of the input signals. In the embodiment, the signal processing unit 20 determines the signal value $X_{4-(p,\ q)}$ based on $Min_{(p,\ q)}$, the expansion coefficient α, and the constant χ. More specifically, as described above, the signal processing unit 20 obtains the signal value $X_{4-(p,\ q)}$ based on the expression (4). The signal processing unit 20 obtains the signal value $X_{4-(p,\ q)}$ for all of the $P_0 \times Q_0$ pixels 48.

Fourth Process

Subsequently, the signal processing unit 20 obtains the signal value $X_{1-(p,\ q)}$ in the (p, q)-th pixel 48 based on the signal value $x_{1-(p,\ q)}$, the expansion coefficient α, and the signal value $X_{4-(p,\ q)}$, obtains the signal value $X_{2-(p,\ q)}$ in the (p, q)-th pixel 48 based on the signal value $X_{2-(p,\ q)}$, the expansion coefficient α, and the signal value $X_{4-(p,\ q)}$, and obtains the signal value $X_{3-(p,\ q)}$ in the (p, q)-th pixel 48 based on the signal value $x_{3-(p,\ q)}$, the expansion coefficient α, and the signal value $X_{4-(p,\ q)}$. Specifically, the signal processing unit 20 obtains the signal value $X_{1-(p,\ q)}$, the signal value $X_{2-(p,\ q)}$, and the signal value $X_{3-(p,\ q)}$ in the (p, q)-th pixel 48 based on the expressions (1) to (3) described above.

The signal processing unit 20 expands a value of $Min_{(p,\ q)}$ with α as represented by the expression (4). In this way, the value of $Min_{(p,\ q)}$ is expanded by α, so that the luminance of the white display sub-pixel (fourth sub-pixel 49W) increases, and the luminance of the red, green and blue display sub-pixels (corresponding to the first, the second, and the third sub-pixels 49R, 49G, and 49B, respectively) also increase as represented by the above expressions. Due to this, dullness of color can be prevented. That is, the luminance of the entire image is multiplied by α because the value of $Min_{(p,\ q)}$ is expanded by α, compared with the case in which the value of $Min_{(p,\ q)}$ is not expanded. Accordingly, for example, a static image and the like can be preferably displayed with high luminance.

The luminance displayed by the output signals $X_{1-(p,\ q)}$, $X_{2-(p,\ q)}$, $X_{3-(p,\ q)}$, and $X_{4-(p,\ q)}$ in the (p, q)-th pixel 48 is expanded α times the luminance formed by the input signals $x_{1-(p,\ q)}$, $x_{2-(p,\ q)}$, and $x_{3-(p,\ q)}$. Accordingly, the display device 10 may reduce the luminance of the surface light source device 50 based on the expansion coefficient α so as to cause the luminance of the pixel 48 to be the same as that of the pixel 48 that is not expanded. Specifically, the luminance of the surface light source device 50 may be multiplied by (1/α).

Determination of Light Quantity of Surface Light Source Device

Figure 7:
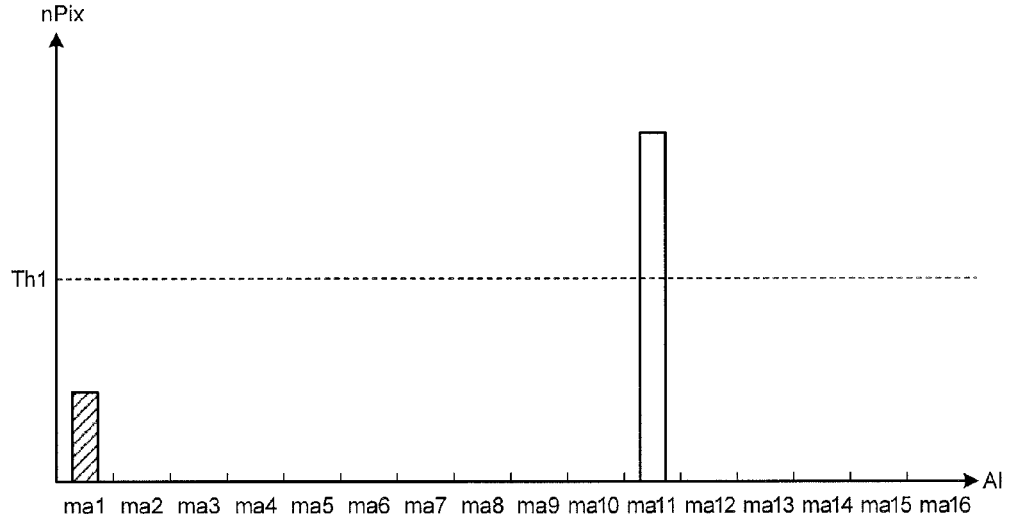
FIG. 7 illustrates an example of frequency distribution of input signals.
Figure 8:
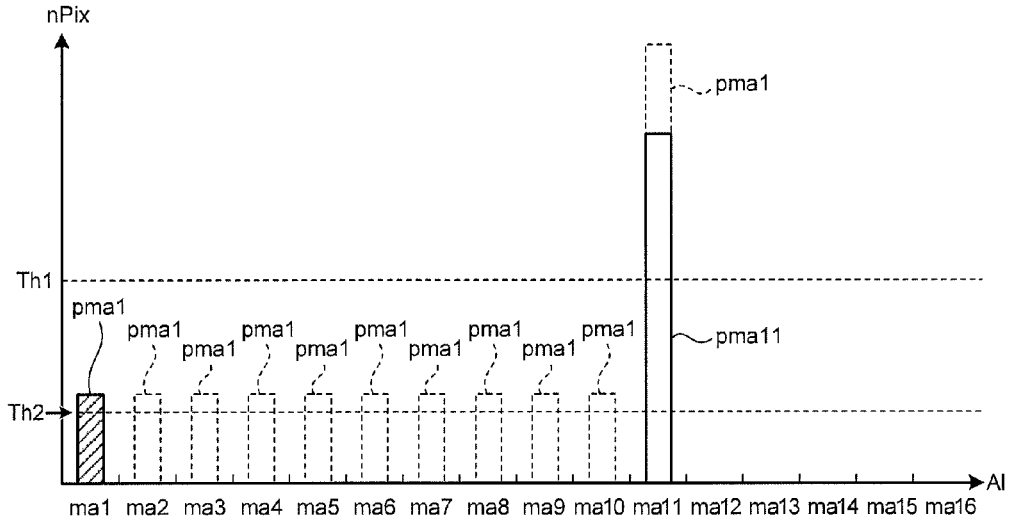
FIG. 8 is a diagram for explaining a cumulative plot of the frequency distribution of FIG. 7.
Figure 9:
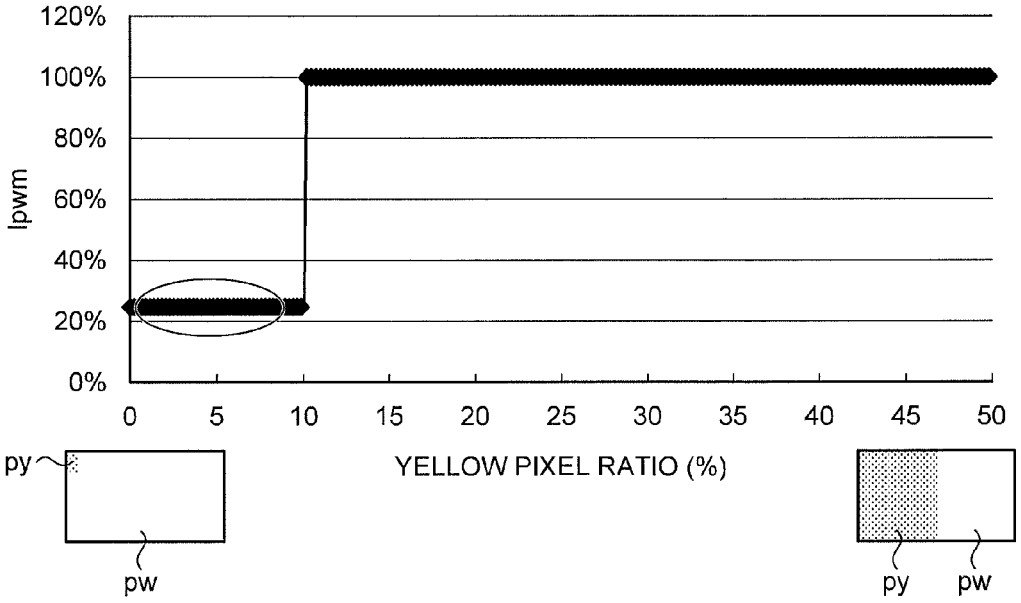
FIG. 9 is a diagram for explaining an example in which a replacement ratio of a fourth sub-pixel significantly changes at a particular pixel ratio due to a predetermined threshold.
Figure 10:
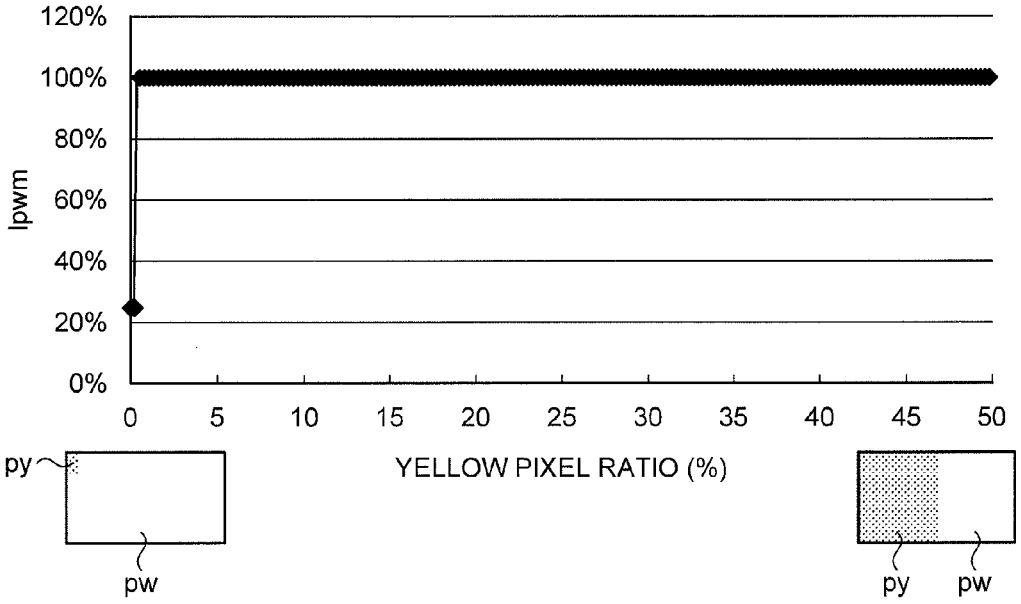
FIG. 10 is a diagram for explaining an example in which the replacement ratio of the fourth sub-pixel significantly changes at a particular pixel ratio due to the predetermined threshold.

As described above, the surface light source device control circuit 60 adjusts, for example, the electric current to be supplied to the surface light source device 50 using, for example, the pulse width modulation (PWM) based on the surface light source device control signal output from the signal processing unit 20 to adjust the output power of the surface light source device 50 (corresponding to the light source power to be described below). This adjustment controls the light quantity (light intensity) of the light with which the image display panel (display unit) 30 is irradiated. Due to this, the controlled variable adjusted with PWM is proportional to (1/α) mentioned above. FIG. 7 illustrates an example of frequency distribution of input signals. FIG. 8 is a diagram for explaining a cumulative plot of the frequency distribution of FIG. 7. Each of FIGS. 9 and 10 is a diagram for explaining an example in which a replacement ratio of the fourth sub-pixel significantly changes at a particular pixel ratio due to a predetermined threshold. Using FIGS. 7 to 10, the following describes a case in which the input signals cause some of all pixels of the image display panel (display unit) 30 to display yellow, and cause the remaining pixels to display white.

As illustrated in FIG. 7, the signal processing unit 20 calculates a frequency nPix of pixels belonging to each of a plurality of partitions (for example, 16 equally divided partitions) ma1 to ma16 using a light quantity Al (light intensity) of the light with which the image display panel (display unit) 30 is irradiated as a variable. This calculation counts yellow-displaying pixels py (refer to FIG. 9) in the partition ma1, and counts white-displaying pixels pw (refer to FIG. 9) in the partition ma11. The partition ma1 is a partition from which the largest light quantity is emitted by the surface light source device 50, thus being a partition having the maximum light quantity. The light quantity Al can be reduced in the sequence of the partition ma2, the partition ma3, and so on. The signal processing unit 20 stores in advance a threshold Th1 for determining the light quantity Al of the light with which the image display panel (display unit) 30 is irradiated, and controls the surface light source device 50 with PWM so as to emit the light quantity Al of a partition in which the cumulative frequency exceeds the threshold Th1 in the cumulative frequency distribution illustrated in FIG. 8.

The cumulative frequency distribution illustrated in FIG. 8 is calculated using only the number of pixels pma1 obtained by counting the yellow-displaying pixels py (refer to FIG. 9) in the partition ma1 and the number of pixels pma11 obtained by counting the white-displaying pixels pw (refer to FIG. 9) in the partition ma11. If the number of pixels pma1 does not exceed the threshold Th1, the cumulative frequency stays at the number of pixels pma1 from the partition ma2 to the partition ma10. Due to this, the cumulative frequency exceeds the threshold Th1 for the first time at the partition ma11, so that the signal processing unit 20 controls the surface light source device 50 with PWM so as to emit the light quantity Al corresponding to the partition ma11.

As illustrated in FIG. 9, when white is displayed, the display device 10 can increase the replacement ratio of the fourth sub-pixel so as to cause the luminance to be the same as that of a pixel 48 (that is not expanded) displayed using only the first, the second, and the third sub-pixels. As a result, the surface light source device 50 can reduce a light source power amount 1 pwm (for example, to approximately 20% in FIG. 9) based on the expansion coefficient α for obtaining the light quantity Al. If the luminance of the backlight is reduced in accordance with that of particular pixels displayed by input signals, that is, the white-displaying pixels pw, the luminance of the yellow-displaying pixels py (refer to FIG. 9) at which other pixels should perform display may become insufficient, so that appropriate color components may not be allowed to be displayed.

After the ratio of the yellow-displaying pixels py to the white-displaying pixels pw (hereinafter, called the yellow pixel ratio) is increased, the signal processing unit 20 controls the surface light source device 50 with PWM so as to emit the light quantity Al corresponding to the partition ma1 if the number of pixels pma1 in the partition ma1 exceeds the threshold in FIG. 8. Human visibility is high for yellow, and the replacement ratio of the fourth sub-pixel cannot easily be increased, so that the light source power amount 1 pwm cannot help but increase. In this manner, as illustrated in FIG. 9, the light source power amount 1 pwm significantly changes (for example, changes from 20% to 100%) at a particular yellow pixel ratio. For example, if the ratio of the yellow-displaying pixels py to the white-displaying pixels pw significantly changes in an image represented by received input signals, the light source power amount 1 pwm, that is, the replacement ratio of the fourth sub-pixel rapidly changes between before and after the change in the ratio, so that the color tone of yellow having high visibility may change. The embodiment is described by exemplifying yellow, and the change in the color tone also needs to be suppressed in a region from yellow to red illustrated in FIG. 6. The color space in a region with high saturation (for example, a region in which the saturation S is 0.8 or higher) is also likely to be affected by the change in the replacement ratio of the fourth sub-pixel, regardless of the hue. As illustrated in FIG. 8, the change in the replacement ratio of the fourth sub-pixel can also be suppressed by reducing the threshold from the threshold Th1 to a threshold Th2 so that the number of pixels pma1 exceeds the threshold Th2 even in the partition ma1. However, as illustrated in FIG. 10, if the threshold is reduced from the threshold Th1 to the threshold Th2, the light source power amount 1 pwm remains high, so that the power consumption cannot be reduced.

Figure 11:
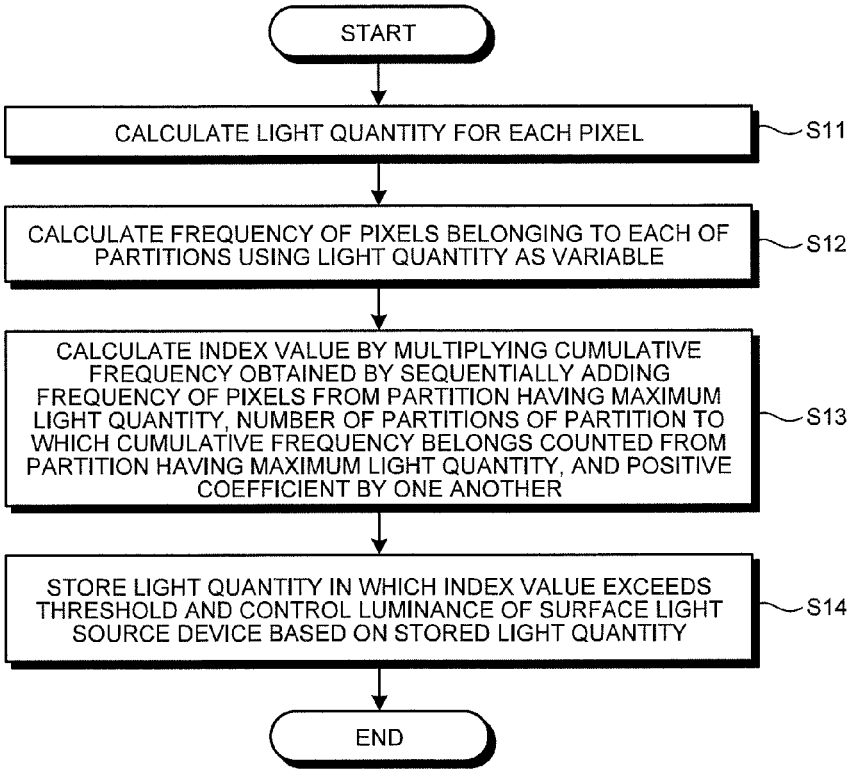
FIG. 11 is a flowchart for explaining a processing procedure of color conversion processing according to the embodiment.
Figure 12:
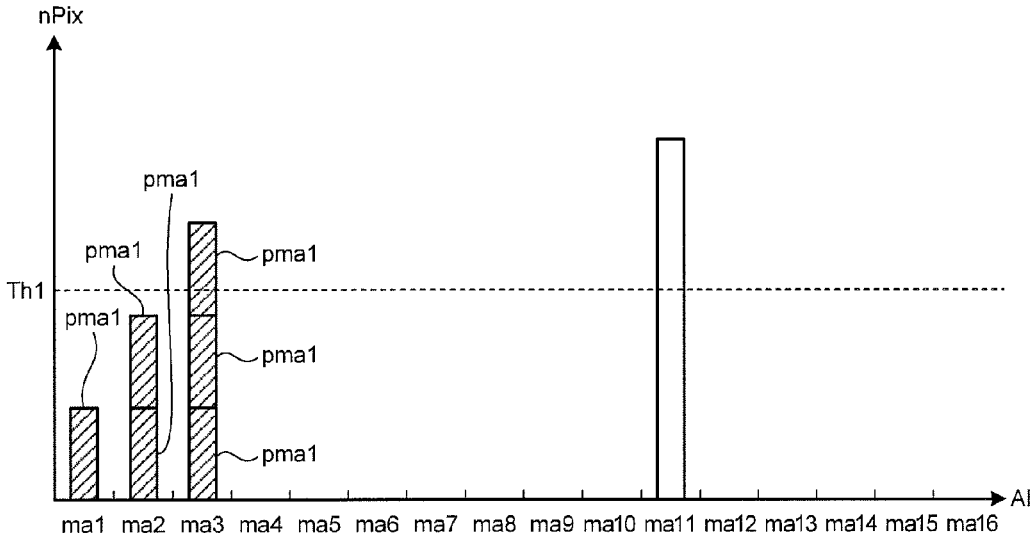
FIG. 12 is a diagram for explaining a relation between an index value and the threshold according to the embodiment.
Figure 13:
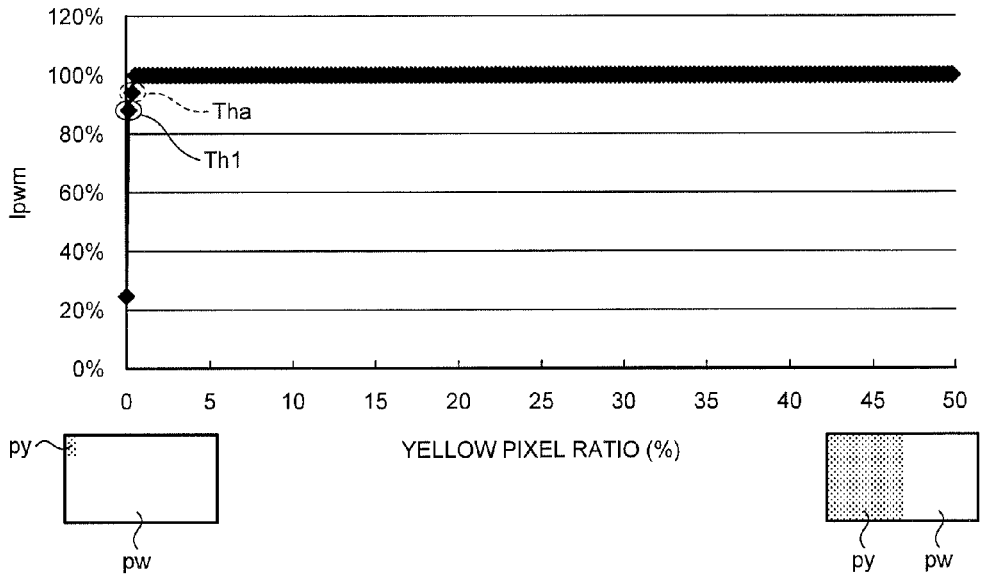
FIG. 13 is a diagram for explaining the replacement ratio of the fourth sub-pixel in the embodiment.

FIG. 11 is a flowchart for explaining a processing procedure of color conversion processing according to the embodiment. FIG. 12 is a diagram for explaining a relation between an index value and the threshold according to the embodiment. FIG. 13 is a diagram for explaining the replacement ratio of the fourth sub-pixel in the embodiment. The following describes, with reference to FIGS. 7, 8, 9, 10, 11, 12, and 13, a color conversion method that can suppress deterioration in display quality while reducing the power consumption.

As illustrated in FIG. 11, the signal processing unit 20 performs the calculations in the first process and the second process described above, obtains the expansion coefficient α for each of the pixels 48, and obtains an optimal light quantity for each of the pixels 48 (Step S11).

Next, the signal processing unit 20 calculates the frequency nPix of pixels belonging to each of the partitions (for example, 16 equally divided partitions) ma1 to ma16 using the light quantity Al (light intensity) of the light with which the image display panel (display unit) 30 is irradiated as a variable (Step S12). The signal processing unit 20 stores such frequency distribution as that illustrated in FIG. 7.

Next, the signal processing unit 20 sequentially adds the frequency nPix of pixels to partitions starting from the partition ma1 having the maximum light quantity to calculate the cumulative frequency. For example, the cumulative frequency distribution is obtained as illustrated in FIG. 8. The signal processing unit 20 then multiplies the number of partitions to which the cumulative frequency belongs counted from the partition having the maximum light quantity by a coefficient k (k is any positive number), and further multiplies the result by the cumulative frequency to calculate the index value (Step S13). For example, the coefficient k is any value of 0.5, 1, 1.5, 2, 2.5, and 3. However, the values of the coefficient k are examples, and different values may be used depending on the partition. First, the following describes a case in which k=1.

The signal processing unit 20 sequentially calculates the index value from the partition ma1 having the maximum light quantity. For example, as illustrated in FIG. 12, in the partition ma1, the number of pixels pma1 obtained by counting the yellow-displaying pixels py (refer to FIG. 13) in the partition ma1, the number of partitions 1 counted from the partition ma1 having the maximum light quantity, and the coefficient k are multiplied by one another to obtain the index value as follows: 1×pma1×k=pma1. Next, in the partition ma2, the number of pixels pma1 obtained by counting the yellow-displaying pixels py (refer to FIG. 13) in the partition ma1, the number of partitions 2 counted from the partition ma1 having the maximum light quantity, and the coefficient k are multiplied by one another to obtain the index value as follows: 2×pma1×k=2×pma1. In the partition ma3, the number of pixels pma1 obtained by counting the yellow-displaying pixels py (refer to FIG. 13) in the partition ma1, the number of partitions 3 counted from the partition ma1 having the maximum light quantity, and the coefficient k are multiplied by one another to obtain the index value as follows: 3×pma1×k=3×pma1. The signal processing unit 20 stores the light quantity Al corresponding to the partition ma3 in which the obtained index value exceeds the threshold Th1, and the signal processing unit 20 adjusts the output of the light quantity so as to be the stored light quantity Al corresponding to the partition ma3, and controls the surface light source device 50 with PWM (Step S14). This operation allows the signal processing unit 20 to control the luminance of the surface light source device 50.

If k=1 at Step S13, the signal processing unit 20 may omit the multiplication by the coefficient k. For example, as illustrated in FIG. 12, in the partition ma1, the number of pixels pma1 obtained by counting the yellow-displaying pixels py (refer to FIG. 13) in the partition ma1 is multiplied by the number of partitions 1 counted from the partition ma1 having the maximum light quantity to obtain pma1. Next, in the partition ma2, the number of pixels pma1 obtained by counting the yellow-displaying pixels py (refer to FIG. 13) in the partition ma1 is multiplied by the number of partitions 2 counted from the partition ma1 having the maximum light quantity to obtain 2×pma1. In the partition ma3, the number of pixels pma1 obtained by counting the yellow-displaying pixels py (refer to FIG. 13) in the partition ma1 is multiplied by the number of partitions 3 counted from the partition ma1 having the maximum light quantity to obtain 3×pma1. The signal processing unit 20 stores the light quantity Al corresponding to the partition ma3 in which the obtained index value exceeds the threshold Th1, and the signal processing unit 20 adjusts the output of the light quantity so as to be the stored light quantity Al corresponding to the partition ma3, and controls the surface light source device 50 with PWM (Step S14).

As illustrated in FIG. 13, the signal processing unit 20 can reduce power at the light quantity Al corresponding to the partition ma3, and can therefore suppress deterioration in display quality while reducing the power even in a region in which the yellow pixel ratio is low.

While the example has been illustrated in which the signal processing unit 20 obtains (number of partitions n)×(number of pixels pma1)×(coefficient k) at Step S13, the embodiment is not limited to this example. The index value may be calculated based on (number of pixels pma1)×(coefficient k). For example, the signal processing unit 20 sequentially calculates the index value from the partition ma1 having the maximum light quantity. For example, as illustrated in FIG. 12, in the partition ma1, the index value is calculated in the following way. Because the number of pixels serving as the cumulative frequency on the side closer to the partition ma1 having the maximum light quantity than the partition ma1 having the maximum light quantity is 0, the number of pixels pma1 obtained by counting the yellow-displaying pixels py (refer to FIG. 13) in the partition ma1 is added to a value obtained by multiplying 0 by the coefficient k, and thus, the index value is obtained as follows: pma1+0×k=pma1. Next, in the partition ma2, the number of pixels pma1 serving as the cumulative frequency is added to a value pma1×k obtained by multiplying the index value pma1 of the partition ma1 lying closer to the partition having the maximum light quantity than the target partition by the positive coefficient k (=1) set for the partition ma2, and thus, the index value is obtained as follows: pma1+pma1×1=2×pma1. In the partition ma3, the number of pixels pma1 serving as the cumulative frequency is added to a value pma1×k obtained by multiplying the index value 2×pma1 of the partition ma2 lying closer to the partition having the maximum light quantity than the target partition ma3 by the positive coefficient k (=1) set for the partition ma2, and thus, the index value is obtained as follows: pma1+2×pma1×1=3×pma1. The number of pixels pma1 obtained by counting the yellow-displaying pixels py (refer to FIG. 13) in the partition ma3, the number of partitions 3 counted from the partition ma1 having the maximum light quantity, and the coefficient k are multiplied by one another to obtain the index value as follows: 3×pma1×k=3×pma1. The signal processing unit 20 stores the light quantity Al corresponding to the partition ma3 in which the obtained index value exceeds the threshold Th1, and the signal processing unit 20 adjusts the output of the light quantity so as to be the stored light quantity Al corresponding to the partition ma3, and controls the surface light source device 50 with PWM (Step S14). This operation allows the signal processing unit 20 to control the luminance of the surface light source device 50.

Figure 14:
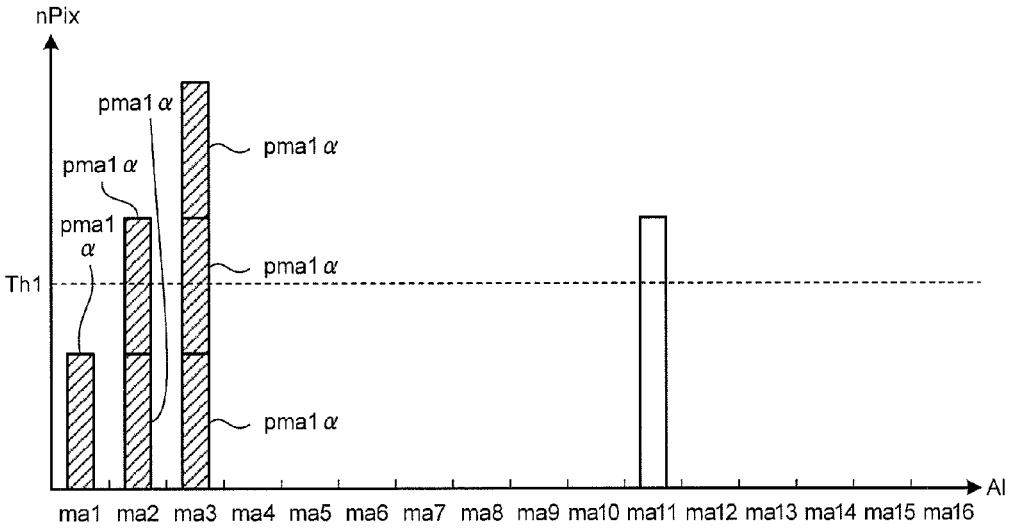
FIG. 14 is a diagram for explaining another example of the relation between the index value and the threshold according to the embodiment.

While the description has been made of the case in which the coefficient k is 1, and the signal processing unit 20 multiplies the number of partitions of the partition to which the cumulative frequency belongs counted from the partition having the maximum light quantity by the coefficient k, and further multiplies the result by the cumulative frequency to calculate the index value, the embodiment is not limited to this case. FIG. 14 is a diagram for explaining another example of the relation between the index value and the threshold according to the embodiment.

First, as illustrated in FIG. 11, the signal processing unit 20 performs the calculations in the first process and the second process, obtains the expansion coefficient α for each of the pixels 48, and obtains the optimal light quantity for each of the pixels 48 (Step S11).

Next, the signal processing unit 20 calculates the frequency nPix of pixels belonging to each of the partitions (for example, 16 equally divided partitions) ma1 to ma16 using the light quantity Al (light intensity) of the light with which the image display panel (display unit) 30 is irradiated as a variable (Step S12). The signal processing unit 20 stores such frequency distribution as that illustrated in FIG. 7. Then, as illustrated in FIG. 14, assuming that the coefficient k is 1.5, the signal processing unit 20 multiplies the number of partitions of the partition to which the cumulative frequency belongs counted from the partition having the maximum light quantity by the coefficient k, and further multiplies the result by the cumulative frequency to calculate the index value (Step S13).

The signal processing unit 20 sequentially calculates the index value from the partition ma1 having the maximum light quantity. For example, as illustrated in FIG. 12, in the partition ma1, the number of pixels pma1 obtained by counting the yellow-displaying pixels py (refer to FIG. 14) in the partition ma1, the number of partitions 1 counted from the partition ma1 having the maximum light quantity, and the coefficient k are multiplied by one another to obtain pma1α. Next, in the partition ma2, the number of pixels pma1 obtained by counting the yellow-displaying pixels py (refer to FIG. 14) in the partition ma1 is multiplied by the number of partitions 2 counted from the partition ma1 having the maximum light quantity to obtain the index value as follows: 2×pma1×k=2×pma1α. In the partition ma3, the number of pixels pma1 obtained by counting the yellow-displaying pixels py (refer to FIG. 14) in the partition ma1, the number of partitions 3 counted from the partition ma1 having the maximum light quantity, and the coefficient k are multiplied by one another to obtain the index value as follows: 3×pma1α×k=3×pma1α. The signal processing unit 20 stores the light quantity Al corresponding to the partition ma2 in which the obtained index value exceeds the threshold Th1, and the signal processing unit 20 adjusts the output of the light quantity so as to be the stored light quantity Al corresponding to the partition ma2, and controls the surface light source device 50 with PWM (Step S14). As illustrated in FIG. 13, the signal processing unit 20 can reduce power at the light quantity Al represented by Tha corresponding to the partition ma2, and can therefore reduce power even in a region in which the yellow pixel ratio is low. In this way, the signal processing unit 20 can suppress deterioration in display quality while reducing the power even in a region in which the yellow pixel ratio is lower.

The coefficient k may be any positive number, but is preferably 1 or larger because, when the coefficient k is 1 or larger, the deterioration in display quality can be more suppressed than when the coefficient k is smaller than 1, while the power is being reduced even in a region in which the yellow pixel ratio is lower.

Figure 15:
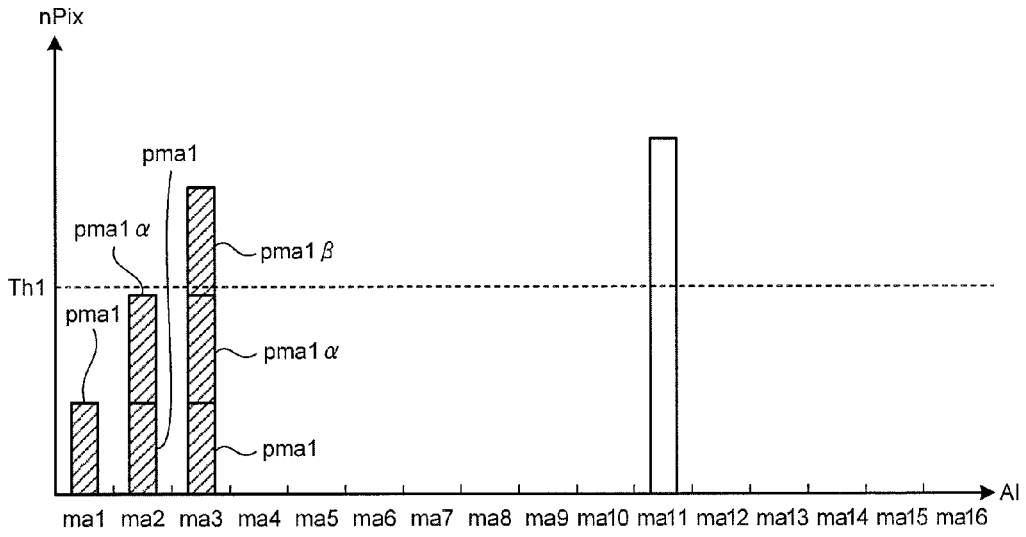
FIG. 15 is a diagram for explaining still another example of the relation between the index value and the threshold according to the embodiment.

FIG. 15 is a diagram for explaining still another example of the relation between the index value and the threshold according to the embodiment. The following describes, with reference to FIG. 15, a case in which the coefficient k has different values set depending on the partition. In the example illustrated in FIG. 15, the value of the coefficient k is 1 in the partition ma1. In the example illustrated in FIG. 15, the value of the coefficient k is 1.1 in the partition ma2. In the example illustrated in FIG. 15, the value of the coefficient k is 1.1 in the partition ma3. At Step S13, for example, the signal processing unit 20 sequentially calculates the index value from the partition ma1 having the maximum light quantity. For example, as illustrated in FIG. 12, in the partition ma1, the index value is calculated in the following way. Because the number of pixels serving as the cumulative frequency on the side closer to the partition ma1 having the maximum light quantity than the partition ma1 having the maximum light quantity is 0, the number of pixels pma1 obtained by counting the yellow-displaying pixels py (refer to FIG. 13) in the partition ma1 is added to a value obtained by multiplying 0 by the coefficient k (=1), and thus, the index value is obtained as follows: pma1+0×k=pma1. Next, in the partition ma2, the number of pixels pma1 serving as the cumulative frequency is added to a value pma1×1.1 (=pma1α) obtained by multiplying the index value pma1 of the partition ma1 lying closer to the partition having the maximum light quantity than the target partition by the positive coefficient k (=1.1) set for the partition ma2, and thus, the index value is obtained as pma1+pma1α. In the partition ma3, the number of pixels pma1 serving as the cumulative frequency is added to a value (pma1+pma1α)×1.1 obtained by multiplying the index value pma1+pma1α of the partition ma2 lying closer to the partition having the maximum light quantity than the target partition ma3 by the positive coefficient k (=1.1) set for the partition ma3, and thus, the index value is obtained as pma1+(pma1+pma1α)×1.1. Denoting pma1α×1.1 (=pma1×1.1×1.1) as pma1β, the index value of the partition ma3 is obtained as pma1+pma1α+pma1β. The signal processing unit 20 stores the light quantity Al corresponding to the partition ma3 in which the obtained index value exceeds the threshold Th1, and the signal processing unit 20 adjusts the output of the light quantity so as to be the stored light quantity Al corresponding to the partition ma3, and controls the surface light source device 50 with PWM (Step S14). This operation allows the signal processing unit 20 to control the luminance of the surface light source device 50.

Figure 16:
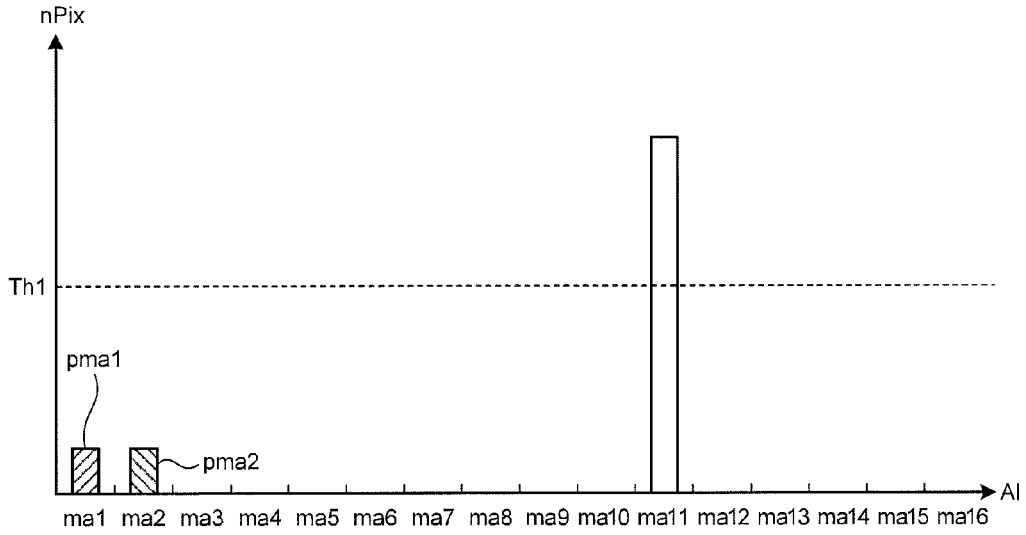
FIG. 16 illustrates an example of the frequency distribution of the input signals.
Figure 17:
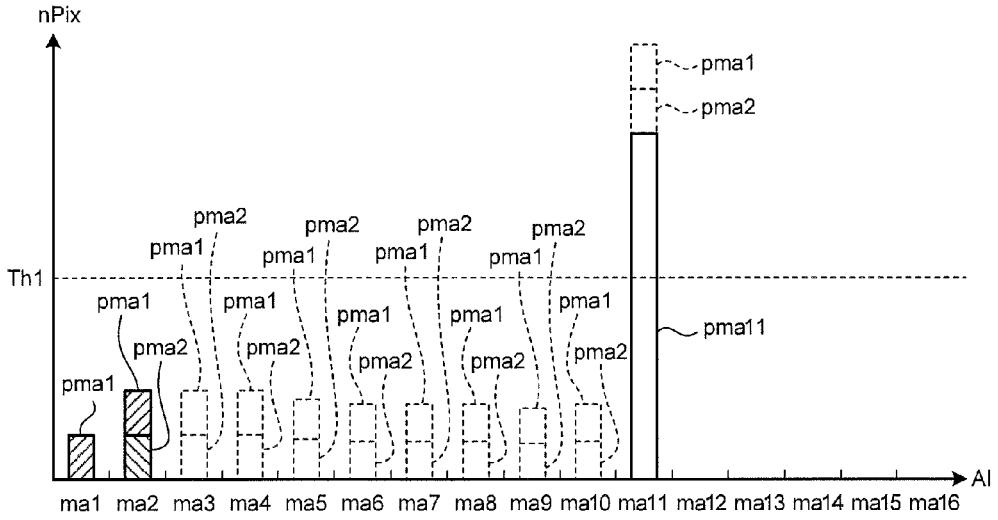
FIG. 17 is a diagram for explaining a cumulative plot of the frequency distribution of FIG. 16.
Figure 18:
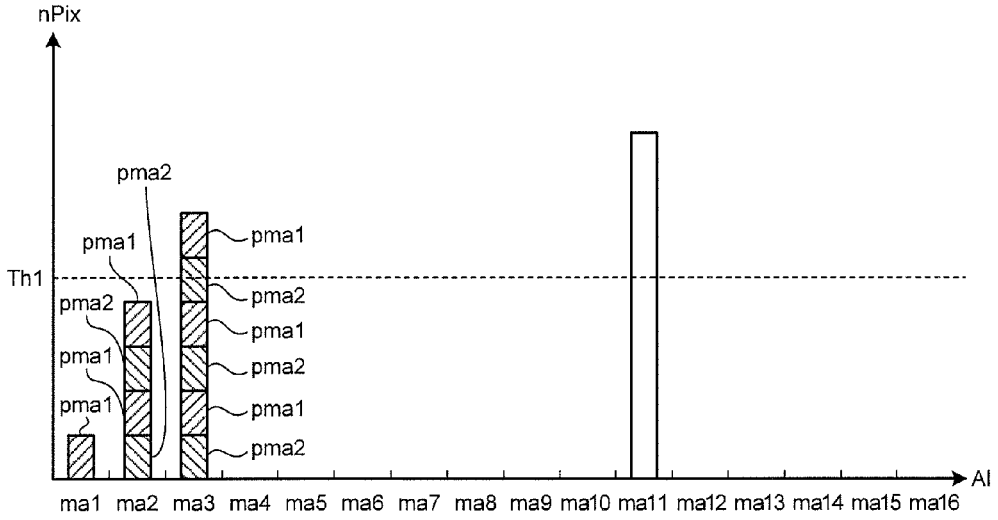
FIG. 18 is a diagram for explaining the relation between the index value and the threshold according to the embodiment.

While the description has been made of the case in which the input signals cause some of all the pixels of the image display panel (display unit) 30 to display yellow, and cause the remaining pixels to display white, the embodiment is not limited to this case. FIG. 16 illustrates an example of the frequency distribution of the input signals. FIG. 17 is a diagram for explaining a cumulative plot of the frequency distribution of FIG. 16. FIG. 18 is a diagram for explaining the relation between the index value and the threshold according to the embodiment. Using FIGS. 11, 16, 17, and 18, the following describes a case in which the input signals cause some of all the pixels of the image display panel (display unit) 30 to display yellow and red, and cause the remaining pixels to display white.

As illustrated in FIG. 11, the signal processing unit 20 performs the calculations in the first process and the second process, obtains the expansion coefficient α for each of the pixels 48, and obtains the optimal light quantity for each of the pixels 48 (Step S11).

Next, the signal processing unit 20 calculates the frequency nPix of pixels belonging to each of the partitions (for example, 16 equally divided partitions) ma1 to ma16 using the light quantity Al (light intensity) of the light with which the image display panel (display unit) 30 is irradiated as a variable (Step S12). The signal processing unit 20 stores such frequency distribution as that illustrated in FIG. 16. For example, when the signal processing unit 20 has calculated the frequency nPix of pixels belonging to each of the partitions (for example, 16 equally divided partitions) ma1 to ma16 using the light quantity Al (light intensity) of the light with which the image display panel (display unit) 30 is irradiated as a variable; the yellow-displaying pixels are counted in the partition ma1; red-displaying pixels are counted in the partition ma2; and the white-displaying pixels are counted in the partition ma11.

Next, the signal processing unit 20 sequentially adds the frequency nPix of pixels to partitions starting from the partition ma1 having the maximum light quantity to calculate the cumulative frequency. For example, as illustrated in FIG. 17, the cumulative frequency distribution is such that, if the sum of the number of pixels pma1 and the number of pixels pma2 does not exceed the threshold Th1, the cumulative frequency stays at the sum of the number of pixels pma1 and the number of pixels pma2 from the partition ma2 to the partition ma10. Due to this, the cumulative frequency exceeds the threshold Th1 for the first time at the partition pma11. The signal processing unit 20 then multiplies the number of partitions of the partition to which the cumulative frequency belongs counted from the partition having the maximum light quantity by a coefficient k (k is any positive number), and further multiplies the result by the cumulative frequency to calculate the index value (Step S13). First, the following describes a case in which k=1. The value of k may, however, be any positive number, as described above.

The signal processing unit 20 sequentially calculates the index value from the partition ma1 having the maximum light quantity. For example, as illustrated in FIG. 18, in the partition ma1, the number of pixels pma1 obtained by counting the yellow-displaying pixels in the partition ma1, the number of partitions 1 counted from the partition ma1 having the maximum light quantity, and the coefficient k are multiplied by one another to obtain pma1. Next, in the partition ma2, the sum of the number of pixels pma1 and the number of pixels pma2 serving as the cumulative frequency illustrated in FIG. 17, the number of partitions 2 counted from the partition ma1 having the maximum light quantity, and the coefficient k are multiplied by one another to obtain 2×(pma1+pma2)×k, that is, 2×(pma1+pma2)×1. In the partition ma3, the sum of the number of pixels pma1 and the number of pixels pma2 serving as the cumulative frequency illustrated in FIG. 17, the number of partitions 3 counted from the partition ma1 having the maximum light quantity, and the coefficient k are multiplied by one another to obtain 3×(pma1+pma2)×k, that is, 3×(pma1+pma2)×1. The signal processing unit 20 stores the light quantity Al corresponding to the partition ma3 in which the obtained index value exceeds the threshold, and the signal processing unit 20 adjusts the output of the light quantity so as to be the stored light quantity Al corresponding to the partition ma3, and controls the surface light source device 50 with PWM (Step S14).

Figure 19:
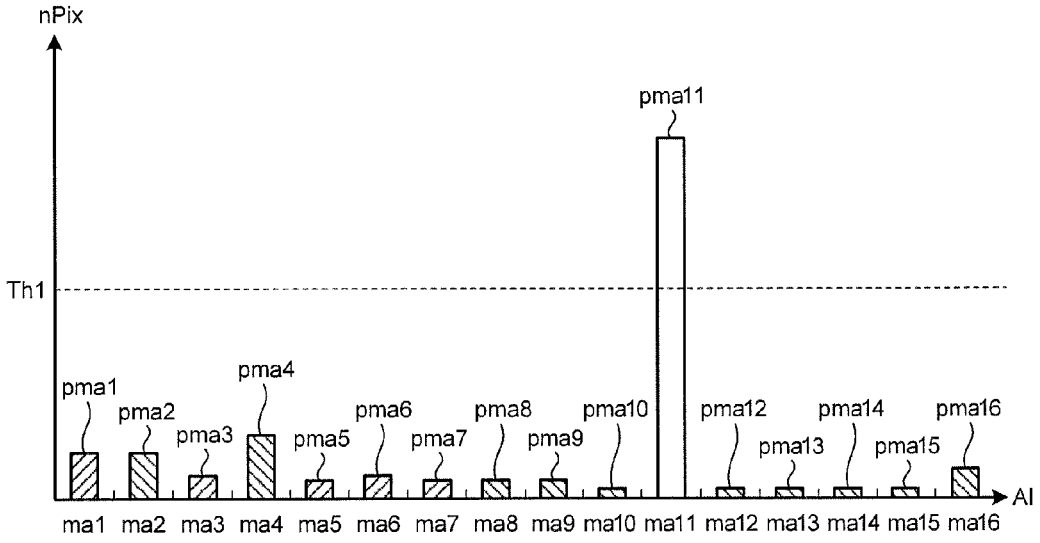
FIG. 19 illustrates an example of the frequency distribution of the input signals.

FIG. 19 illustrates an example of the frequency distribution of the input signals. The description has been made of the case in which the input signals cause some of all the pixels of the image display panel (display unit) 30 to display yellow and red, and cause the remaining pixels to display white. In actuality, the partitions ma1 to ma16 included in the input signals have frequencies nPix of pixels as illustrated in FIG. 19, and the frequencies nPix vary depending on the image. If the frequency nPix of pixels exceeds the threshold Th1 in one of the partitions ma1 to ma16, the signal processing unit 20 adjusts, as usual, the output of the light quantity so as to be the stored light quantity Al corresponding to the partition in which the frequency nPix exceeds, and controls the surface light source device 50 with PWM. According to the display device 10 of the embodiment, the surface light source device 50 can be controlled with PWM based on the light quantity Al corresponding to the partition in which the index value exceeds the threshold Th1, instead of the light quantity Al corresponding to the partition ma11 illustrated in FIG. 19. As a result, appropriate output signals of the fourth sub-pixel that displays the fourth color component different from the first sub-pixel, the second sub-pixel, and the third sub-pixel can be obtained to suppress deterioration in display quality while reducing the power consumption of the display device 10.

Figure 20:
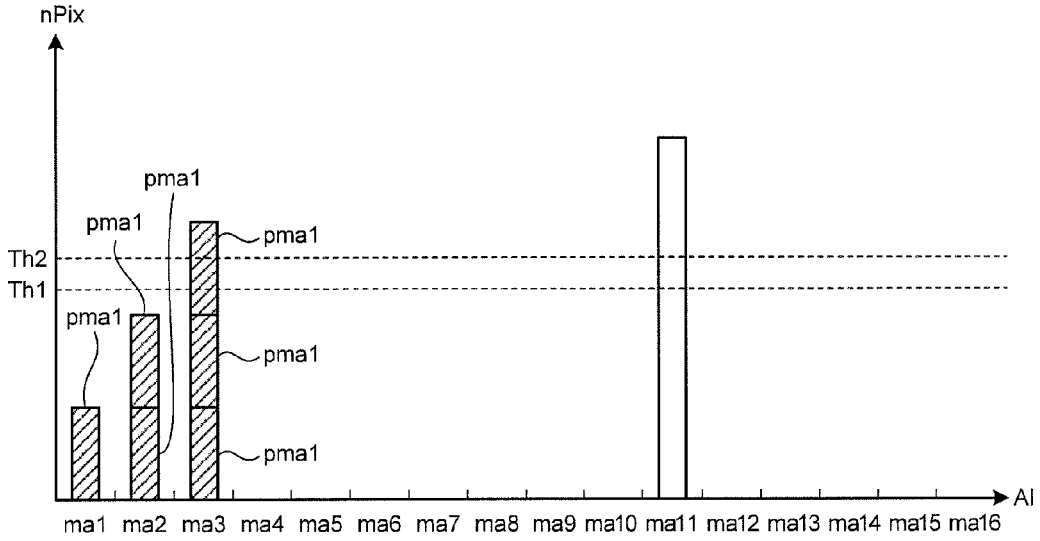
FIG. 20 illustrates an example of the frequency distribution of the input signals.
Figure 21:
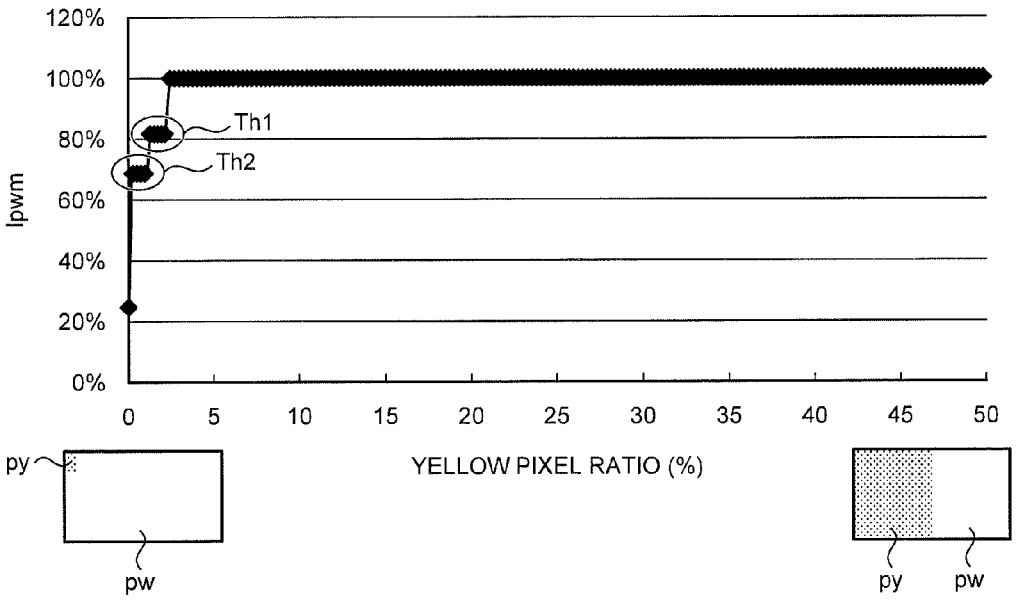
FIG. 21 is a diagram for explaining the replacement ratio of the fourth sub-pixel changed due to thresholds in two steps according to the embodiment.

The signal processing unit 20 may store a threshold higher than the threshold Th1 in addition to the threshold Th1. FIG. 20 illustrates an example of the frequency distribution of the input signals. FIG. 21 is a diagram for explaining the replacement ratio of the fourth sub-pixel changed due to thresholds in two steps according to the embodiment. As illustrated in FIG. 20, the thresholds Th1 and Th2 are stored in the signal processing unit 20. The threshold Th1 is a threshold for the partitions ma1 to ma5, and the threshold Th2 higher than the threshold Th1 is a threshold for the partitions ma6 to ma16. The index value increases as the number of partitions counted from the partition having the maximum light quantity increases. Due to this, the light source power amount 1 pwm can be changed stepwise by selecting each of the threshold Th1 and the threshold Th2 according to the partition, as illustrated in FIG. 21.

Figure 22:
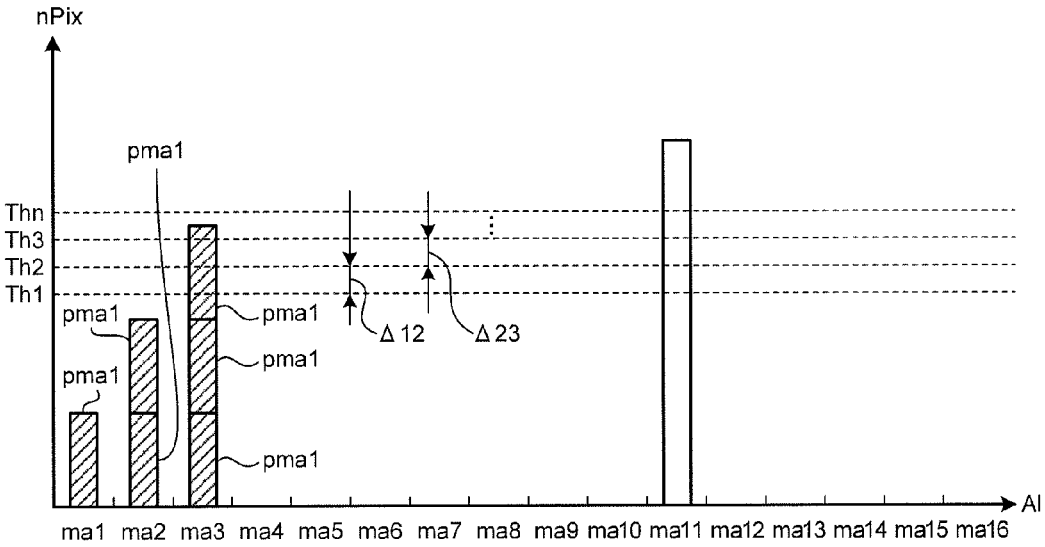
FIG. 22 illustrates an example of the frequency distribution of the input signals.
Figure 23:
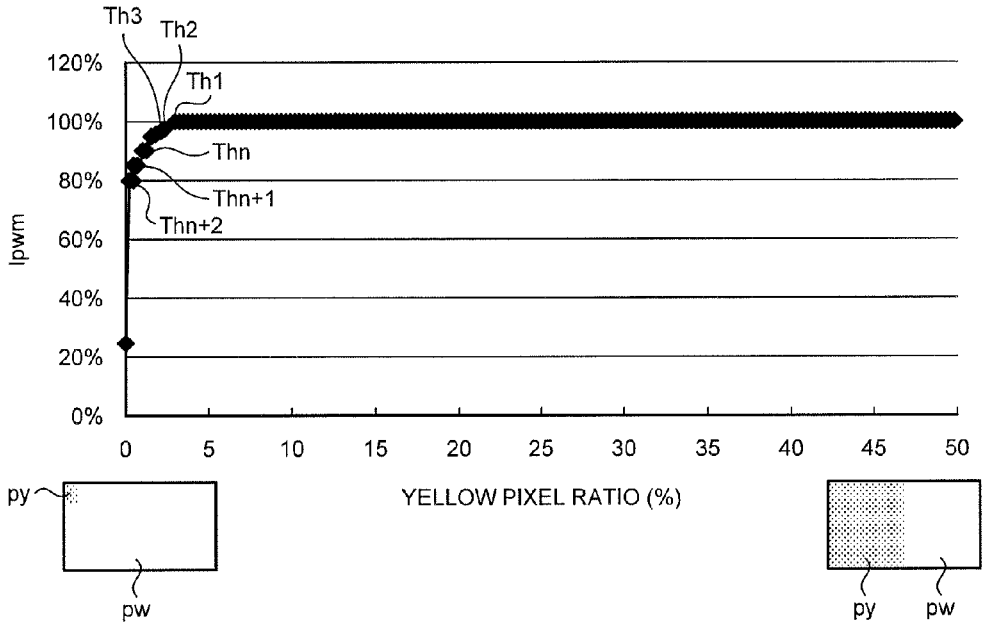
FIG. 23 is a diagram for explaining the replacement ratio of the fourth sub-pixel changed due to thresholds in multiple steps according to the embodiment.

The signal processing unit 20 has a plurality of thresholds stored therein. Instead of the two thresholds, three or more thresholds can be used. FIG. 22 illustrates an example of the frequency distribution of the input signals. FIG. 23 is a diagram for explaining the replacement ratio of the fourth sub-pixel changed due to thresholds in multiple steps according to the embodiment. As illustrated in FIG. 22, the threshold Th1 to threshold Thn (n is a natural number of three or larger) are stored in the signal processing unit 20. The threshold Th1 is a threshold for the partitions ma1 and ma2, and the threshold Th2 higher than the threshold Th1 is a threshold for the partitions ma3 and ma4. Similarly, partitions to be selected are assigned to each of the thresholds. An interval Δ12 between the threshold Th1 and the threshold Th2 is larger than an interval Δ23 between the threshold Th2 and the threshold Th3. The increasing rate of the interval between adjacent thresholds is increased so that the interval sequentially increases from the threshold Th1 to the threshold Thn. Due to this, the signal processing unit 20 can change the light source power amount 1 pwm with respect to the yellow pixel ratio approximately along a curve by selecting each of the thresholds Th1 to Thn according to the partition, as illustrated in FIG. 23. While the description based on FIG. 22 has been made of the example of increasing the increasing rate of the interval between thresholds, the embodiment is not limited to this example. The interval between thresholds may be constant, or mixture of large intervals and small intervals may be used.

Figure 24:
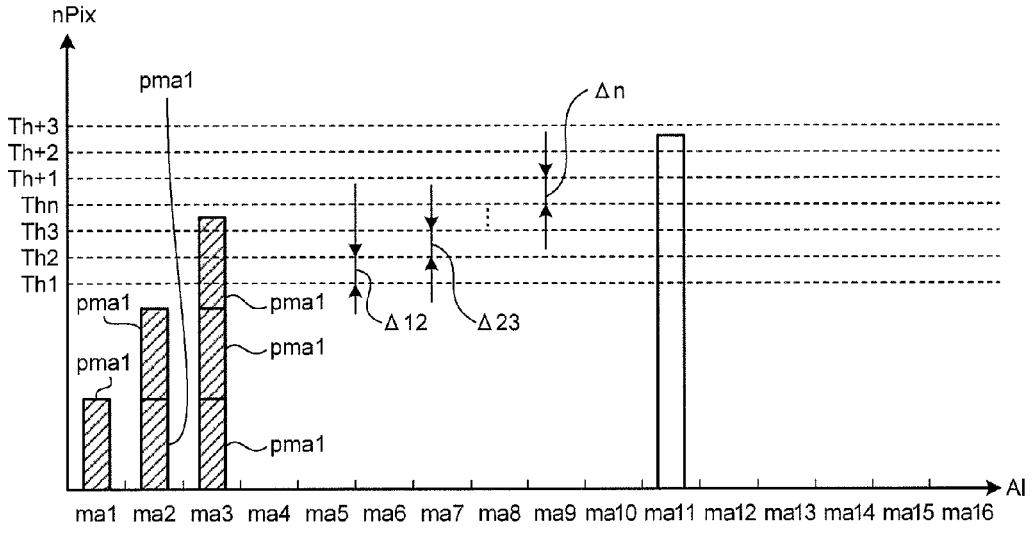
FIG. 24 illustrates an example of the frequency distribution of the input signals.
Figure 25:
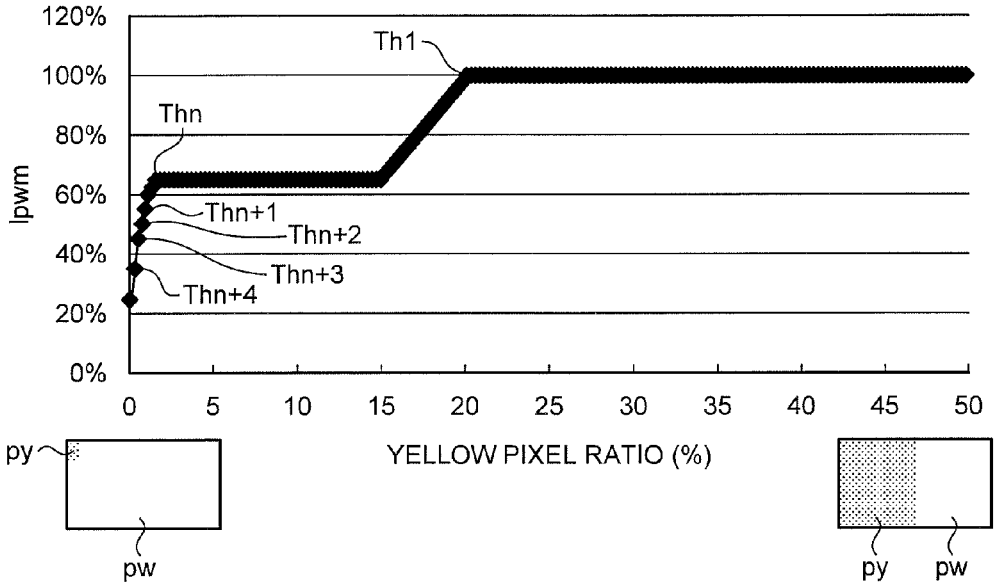
FIG. 25 is a diagram for explaining the replacement ratio of the fourth sub-pixel changed due to thresholds in multiple steps according to the embodiment.

The signal processing unit 20 has a plurality of thresholds stored therein. Instead of the two thresholds, three or more thresholds can be used. FIG. 24 illustrates an example of the frequency distribution of the input signals. FIG. 25 is a diagram for explaining the replacement ratio of the fourth sub-pixel changed due to thresholds in multiple steps according to the embodiment. As illustrated in FIG. 24, the threshold Th1 to the threshold Thn and further to threshold Th+3 (n is a natural number of three or larger, and f is a natural number of n or larger) are stored in the signal processing unit 20. The threshold Th1 is a threshold for the partitions ma1 and ma2, and the threshold Th2 higher than the threshold Th1 is a threshold for the partitions ma3 and ma4. Similarly, partitions to be selected are assigned to each of the thresholds. The interval Δ12 between the threshold Th1 and the threshold Th2 is equal to the interval Δ23 between the threshold Th2 and the threshold Th3. In this way, the intervals between the thresholds T1 to Thn−1 are equal to one another. In contrast, the interval sequentially increases from the threshold Thn to the threshold Thn+4. Intervals between the thresholds Thn+1 to Thn+4 are changed from an interval Δn between the threshold Thn and the threshold Thn+1. Due to this, the signal processing unit 20 can change the light source power amount 1 pwm with respect to the yellow pixel ratio approximately along a curve by selecting each of the threshold Thn+4 to the threshold Thn according to the partition, as illustrated in FIG. 25. The signal processing unit 20 can set the light source power amount 1 pwm to change stepwise with respect to the yellow pixel ratio by selecting the threshold Thn to the threshold Th1. While the description based on FIGS. 22 to 25 has been made of the case in which the number of thresholds is larger than n, the embodiment is not limited to this case. At least the threshold Thn−1 and the threshold Thn only need to be set as thresholds, and the threshold Thn−1 only needs to be determined to be equal to or lower than the threshold Thn.

According to the display device 10 of the embodiment, the signal processing unit 20 calculates the frequency nPix of pixels belonging to each of the partitions ma1 to ma16 using the light quantity Al (light intensity) of the light with which the image display panel (display unit) 30 is irradiated as a variable. The partitions ma1 to ma16 are obtained by equally dividing the possible range of the above-mentioned multiplier (1/α) into 16 partitions. The partitions ma1 to ma16 need not be obtained by equally dividing the possible range of the multiplier (1/α), but may be obtained by dividing the range so that the partition is larger as it is closer to the partition having the maximum light quantity and the multiplier (1/α) is smaller. The partitions ma1 to ma16 may be obtained by dividing the range so that the partition is larger as it is farther from the partition having the maximum light quantity and the multiplier (1/α) is larger. While the partitions ma1 to ma16 have been illustrated as 16 equally divided partitions, the partitions may be 8 equally divided partitions or 4 equally divided partitions, and the number of partitions is not limited to any number.

Application Example

Figure 26:
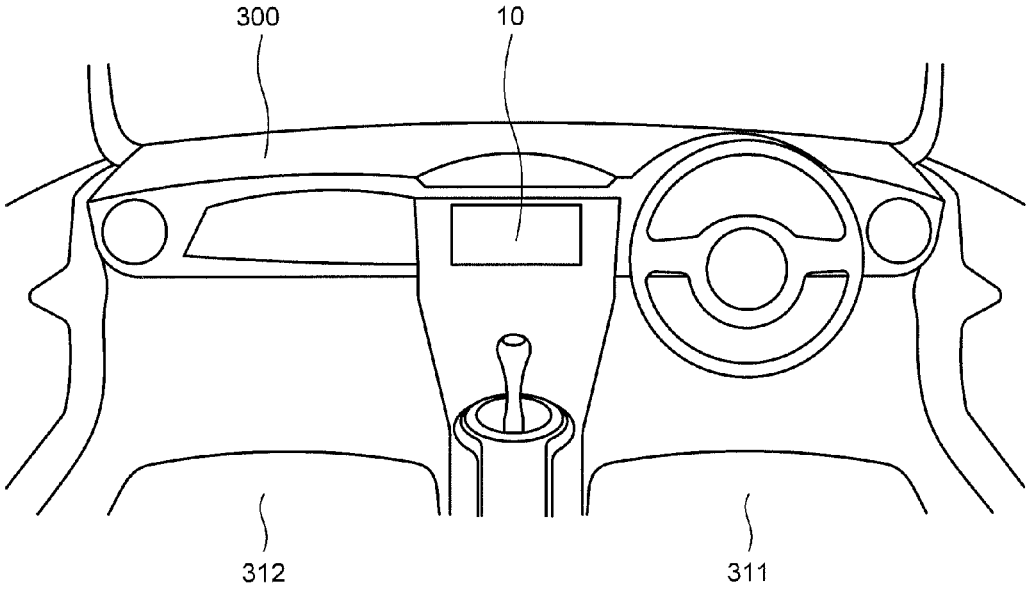
FIG. 26 is a diagram illustrating an example of an electronic apparatus including the display device according to the embodiment.
Figure 27:
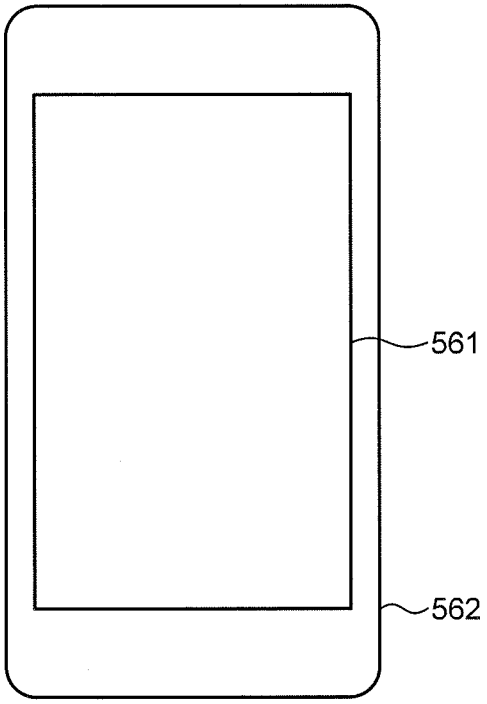
FIG. 27 is a diagram illustrating an example of the electronic apparatus including the display device according to the embodiment.

Next, the following describes an application example of the display device 10 described in the embodiment and the modification thereof with reference to FIGS. 26 and 27. FIGS. 26 and 27 are diagrams illustrating an example of an electronic apparatus to which the display device according to the embodiment is applied. The display device 10 according to the embodiment can be applied to electronic apparatuses in various fields such as a car navigation system illustrated in FIG. 26, a television apparatus, a digital camera, a notebook-type personal computer, a portable electronic apparatus such as a cellular telephone illustrated in FIG. 27, or a video camera. In other words, the display device 10 according to the embodiment can be applied to electronic apparatuses in various fields that display a video signal input from the outside or a video signal generated inside as an image or a video. The electronic apparatus includes the control device 11 (refer to FIG. 1) that supplies the video signal to the display device to control an operation of the display device.

The electronic apparatus illustrated in FIG. 26 is a car navigation device to which the display device 10 according to the embodiment and the modification thereof is applied. The display device 10 is arranged on a dashboard 300 in an automobile. Specifically, the display device 10 is arranged on the dashboard 300 and between a driver's seat 311 and a passenger seat 312. The display device 10 of the car navigation device is used for displaying navigation, displaying a music operation screen, or reproducing and displaying a movie.

The electronic apparatus illustrated in FIG. 27 is an information portable terminal, to which the display device 10 according to the embodiment and the modification thereof is applied, that operates as a portable computer, a multifunctional mobile phone, a mobile computer allowing a voice communication, or a communicable portable computer, and may be called a smartphone or a tablet terminal in some cases. This information portable terminal includes a display unit 561 on a surface of a housing 562, for example. The display unit 561 includes the display device 10 according to the embodiment and the modification thereof and a touch detection (what is called a touch panel) function that can detect an external proximity object.

The embodiment is not limited to the above description. The components according to the embodiment described above include a component that is easily conceivable by those skilled in the art, substantially the same component, and what is called an equivalent. The components can be variously omitted, replaced, and modified without departing from the gist of the embodiment described above.

According to the embodiment, the present disclosure includes the following aspects.

(1) A display device including:

a display unit that includes pixels arranged in a matrix therein, each of the pixels including a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel;

a surface light source that irradiates the display unit; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel, wherein the signal processing unit calculates a light quantity of the surface light source necessary for each of the pixels, and calculates a frequency of pixels belonging to each of a plurality of partitions using the obtained light quantity of the surface light source as a variable;

the signal processing unit calculates an index value for each of the partitions by at least multiplying the cumulative frequency being obtained by sequentially adding the frequency of pixels from a partition having the maximum light quantity among the partitions, and the number of partitions representing a position of a partition to which the cumulative frequency belongs counted from the partition having the maximum light quantity; and the signal processing unit controls luminance of the surface light source based on a partition in which the index value exceeds a threshold.

(2) The display device according to (1), wherein the index value is calculated for each of the partitions by multiplying by the cumulative frequency obtained by sequentially adding the frequency of pixels from the partition having the maximum light quantity among the partitions, the number of partitions representing the position of the partition to which the cumulative frequency belongs counted from the partition having the maximum light quantity, and a positive coefficient.

(3) The display device according to (1) or (2), wherein a plurality of thresholds are stored and any of the thresholds is selected according to the partition.

(4) The display device according to (3), wherein the selected threshold increases as the number of partitions increases.

(5) The display device according to (4), wherein an increasing rate of an interval between adjacent ones of the thresholds sequentially increases.

(6) A display device including:

a display unit that includes pixels arranged in a matrix therein, each of the pixels including a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel;

a surface light source that irradiates the display unit; and a signal processing unit that receives input signals that are capable of being displayed with the first sub-pixel, the second sub-pixel, and the third sub-pixel, and calculates output signals to the first sub-pixel, the second sub-pixel, the third sub-pixel, and the fourth sub-pixel, wherein the signal processing unit calculates a light quantity of the surface light source necessary for each of the pixels, and calculates a frequency of pixels belonging to each of a plurality of partitions using the obtained light quantity of the surface light source as a variable;

the signal processing unit obtains a cumulative frequency by sequentially adding the frequency of pixels from a partition having the maximum light quantity among the partitions, and calculates an index value for each of the partitions, the index value being for each of the partitions, by adding the cumulative frequency of a target partition to a value obtained by multiplying an index value of a partition lying closer to the partition having the maximum light quantity than the target partition by a positive coefficient set for the target partition; and the signal processing unit controls luminance of the surface light source based on a partition in which the index value exceeds a threshold.

(7) The display device according to (6), wherein a plurality of thresholds are stored and any of the thresholds is selected according to the partition.

(8) The display device according to (7), wherein the selected threshold increases as the number of partitions increases.

(9) The display device according to (8), wherein an increasing rate of an interval between adjacent ones of the thresholds sequentially increases.

What is claimed is:

1. A display device comprising:

a display unit that includes pixels arranged in a matrix therein, each of the pixels including a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel;

a light source that irradiates the display unit; and a signal processing unit that is configured to receive input signals that are capable of being displayed with the first sub-pixel, the second sub-pixel, and the third sub-pixel, calculate output signals to the first sub-pixel, the second sub-pixel, the third sub-pixel, and the fourth sub-pixel, calculate a light quantity of the light source that is necessary for each of the pixels, calculate a frequency of the pixels belonging to each of a plurality of partitions using the light quantity of the light source that is necessary for the each of the pixels as a variable, the each of the plurality of partitions associated with a different light quantity of the light source, obtain a cumulative frequency by sequentially adding the frequency of the pixels from a first partition of the plurality of partitions having a maximum light quantity among the plurality of partitions, calculate an index value for each partition of the plurality of partitions by at least multiplying the cumulative frequency and a number of partitions representing a position of the each partition of the plurality of partitions to which the cumulative frequency belongs counted from the first partition, and control luminance of the light source to emit a target light quantity corresponding to one partition of the plurality of partitions in which the index value exceeds a threshold.

2. The display device according to claim 1, wherein the index value is calculated for the each partition of the plurality of partitions by multiplying by the cumulative frequency, the number of partitions representing the position of the each partition of the plurality of partitions to which the cumulative frequency belongs counted from the first partition, and a positive coefficient.

3. The display device according to claim 1, wherein the signal processing unit is further configured to select one or more thresholds from a plurality of thresholds, the one or more thresholds including the threshold.

4. The display device according to claim 3, wherein the signal processing unit is further configured to select a number of the one or more thresholds based on a number of the plurality of partitions.

5. The display device according to claim 4, wherein the the one or more thresholds is three or more thresholds, and wherein an interval between adjacent ones of the three or more thresholds sequentially increases.

6. A display device comprising:

a display unit that includes pixels arranged in a matrix therein, each of the pixels including a first sub-pixel that displays a first color component, a second sub-pixel that displays a second color component, a third sub-pixel that displays a third color component, and a fourth sub-pixel that displays a fourth color component different from the first sub-pixel, the second sub-pixel, and the third sub-pixel;

a light source that irradiates the display unit; and a signal processing unit that is configured to receive input signals that are capable of being displayed with the first sub-pixel, the second sub-pixel, and the third sub-pixel, calculate output signals to the first sub-pixel, the second sub-pixel, the third sub-pixel, and the fourth sub-pixel, calculate a light quantity of the light source that is necessary for each of the pixels, calculate a frequency of the pixels belonging to each of a plurality of partitions using the light quantity of the light source that is necessary for the each of the pixels as a variable, the each of the plurality of partitions associated with a different light quantity of the light source, obtain a cumulative frequency of a target partition of the plurality of partitions by sequentially adding the frequency of the pixels from a first partition of the plurality of partitions having a maximum light quantity among the plurality of partitions, calculate a target index value for the target partition by adding the cumulative frequency of the target partition to a value obtained by multiplying a second index value of a second partition of the plurality of partitions that is closer to the first partition than the target partition by a positive coefficient set for the target partition, and control luminance of the light source to emit a target light quantity corresponding to one partition of the plurality of partitions in which the target index value exceeds a threshold.

7. The display device according to claim 6, wherein the signal processing unit is further configured to select one or more thresholds from a plurality of thresholds, the one or more thresholds including the threshold.

8. The display device according to claim 7, wherein the signal processing unit is further configured to select a number of the one or more thresholds based on a number of the plurality of partitions.

9. The display device according to claim 8, wherein the one or more thresholds is three or more thresholds, and wherein an interval between adjacent ones of the three or more thresholds sequentially increases.

* * * * *